US009341433B1

(12) United States Patent
Summers et al.

(10) Patent No.: US 9,341,433 B1
(45) Date of Patent: May 17, 2016

(54) DROP AWAY ARROW REST SYSTEM WITH DELAYED RELEASE MECHANISM

(71) Applicants: Daniel A. Summers, Monroe, VA (US); Kenneth P. Green, Lunenburg, VA (US)

(72) Inventors: Daniel A. Summers, Monroe, VA (US); Kenneth P. Green, Lunenburg, VA (US)

( * ) Notice: Subject to any disclaimer, the term of this patent is extended or adjusted under 35 U.S.C. 154(b) by 0 days.

(21) Appl. No.: 14/257,773

(22) Filed: Apr. 21, 2014

Related U.S. Application Data

(60) Provisional application No. 61/813,882, filed on Apr. 19, 2013.

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143; F41B 5/1426
USPC ..... 124/44.5, 86, 88
See application file for complete search history.

(56) References Cited

U.S. PATENT DOCUMENTS 5,117,803 A * 6/1992 Johnson ..... F41B 5/143 124/24.1
5,243,957 A * 9/1993 Neilson ..... F41B 5/10 124/25.6
5,394,858 A 3/1995 Karolian
5,476,086 A * 12/1995 Smith ..... F41B 5/143 124/24.1
5,490,491 A * 2/1996 Troncoso ..... F41B 5/143 124/44.5
5,490,492 A * 2/1996 Savage ..... F41B 5/143 124/44.5
5,722,381 A * 3/1998 Mizek ..... F41B 5/143 124/44.5
6,044,832 A * 4/2000 Piersons, Jr. ..... F41B 5/143 124/44.5
6,178,959 B1 * 1/2001 Troncoso, Jr. ..... F41B 5/143 124/44.5
6,202,635 B1 * 3/2001 Evans ..... F41B 5/143 124/44.5
6,520,170 B1 * 2/2003 Adkins ..... F41G 1/467 124/44.5
6,595,195 B1 * 7/2003 Barner ..... F41B 5/143 124/44.5
6,615,813 B1 * 9/2003 Troncoso, Jr. ..... F41B 5/143 124/44.5
6,637,419 B1 * 10/2003 Troncoso, Jr. ..... F41B 5/143 124/44.5
6,681,753 B2 * 1/2004 Afshari ..... F41B 5/143 124/44.5
6,688,297 B1 * 2/2004 Clague ..... F41B 5/143 124/44.5

(Continued)

*Primary Examiner* — Alexander Niconovich
(74) *Attorney, Agent, or Firm* — Thedford I. Hitaffer; Hitaffer & Hitaffer, PLLC

(57) ABSTRACT

A drop away arrow rest system comprises a rest and a cord lever operatively connected to the rest for moving the rest to a cocked position for supporting an arrow in relation to a bow upon drawing a bow string and upon releasing the bow string, triggering the release of the rest to a drop away position. A delayed release mechanism comprises an end cap and a torsion spring connecting the end cap to the cord lever. The cord lever is configured to load the torsion spring upon drawing the bow string and upon releasing the bow string, first release the load on the torsion spring without triggering the release of the rest to a drop away position, and then trigger the release of the rest to a drop away position.

23 Claims, 25 Drawing Sheets

(56) References Cited

U.S. PATENT DOCUMENTS 6,782,881 B2 * 8/2004 Mizek ..... F41B 5/143 124/44.5
6,789,536 B1 * 9/2004 Summers ..... F41B 5/143 124/44.5
6,913,008 B2 * 7/2005 Simo ..... F41B 5/143 124/44.5
6,948,488 B2 * 9/2005 Afshari ..... F41B 5/143 124/44.5
7,165,543 B2 * 1/2007 Simo ..... F41B 5/143 124/24.1
7,219,662 B1 * 5/2007 Henry ..... F41B 5/143 124/44.5
7,331,338 B2 * 2/2008 Mizek ..... F41B 5/143 124/44.5
7,409,950 B2 * 8/2008 Ellig ..... F41B 5/143 124/44.5
7,597,095 B2 * 10/2009 Grace, Jr. ..... F41B 5/143 124/44.5
7,681,566 B2 * 3/2010 Mertens ..... F41B 5/143 124/44.5
7,717,103 B2 * 5/2010 Johnson ..... F41B 5/143 124/25.6
7,748,371 B1 * 7/2010 Doty ..... F41B 5/143 124/44.5
7,856,968 B2 * 12/2010 Mizek ..... F41B 5/143 124/44.5
8,474,443 B2 * 7/2013 Geno ..... F41B 5/143 124/44.5
8,701,643 B2 * 4/2014 Ellig ..... F41B 5/1438 124/44.5
8,752,536 B2 * 6/2014 Sims ..... F41B 5/10 124/24.1
8,960,174 B2 * 2/2015 Khoshnood ..... F41B 5/143 124/44.5
9,182,190 B2 * 11/2015 Khoshnood ..... F41B 5/143
2003/0024516 A1 * 2/2003 Mizek ..... F41B 5/143 124/44.5
2003/0029429 A1 * 2/2003 Adkins ..... F41G 1/467 124/44.5
2004/0139952 A1 * 7/2004 Simo ..... F41B 5/143 124/44.5
2004/0139954 A1 * 7/2004 Mizek ..... F41B 5/143 124/44.5
2008/0168971 A1 * 7/2008 Mizek ..... F41B 5/143 124/44.5
2008/0216807 A1 * 9/2008 Troncoso ..... F41B 5/143 124/88
2012/0138035 A1 * 6/2012 Ellig ..... F41B 5/1438 124/44.5
2014/0190462 A1 * 7/2014 Khoshnood ..... F41B 5/143 124/86

* cited by examiner

DROP AWAY ARROW REST SYSTEM WITH DELAYED RELEASE MECHANISM

CROSS-REFERENCE TO RELATED APPLICATIONS

This application claims the benefit of U.S. Provisional Application No. 61/813,882, filed Apr. 19, 2013, the disclosure of which is incorporated herein by reference.

BACKGROUND OF THE INVENTION

This invention generally relates to archery, and more particularly, to fall away arrow rests.

Drop away arrow rests are well known. Such rests are typically held in a cocked position, wherein an arrow is contained on the rest while stalking, drawing the bow string, and during slow let downs. However, when the bow string is released to shoot the arrow, the rest is released to a drop away position, wherein the rest is out of the path of travel of the arrow. Well known rests are released to the drop away position promptly upon releasing the string. This often results in an out of tune bow, which often results in inaccuracy.

What is needed is a rest whose release to a drop away position is delayed for a period of time after the string is released to provide additional support for the arrow.

SUMMARY OF THE INVENTION

This invention relates to a drop away arrow rest system with a delayed release mechanism. The system comprises a rest and a cord lever operatively connected to the rest for moving the rest to a cocked position for supporting an arrow in relation to a bow upon drawing a bow string and upon releasing the bow string, triggering the release of the rest to a drop away position. The delayed release mechanism comprises an end cap and a torsion spring connecting the end cap to the cord lever. The cord lever is configured to load the torsion spring upon drawing the bow string and upon releasing the bow string, first release the load on the torsion spring without triggering the release of the rest to a drop away position, and then trigger the release of the rest to a drop away position.

Various advantages of this invention will become apparent to those skilled in the art from the following detailed description of the preferred embodiment, when read in light of the accompanying drawings.

BRIEF DESCRIPTION OF THE DRAWINGS

The same reference numerals refer to the same parts throughout the various figures.

DETAILED DESCRIPTION OF THE PREFERRED EMBODIMENT

Figure 1:
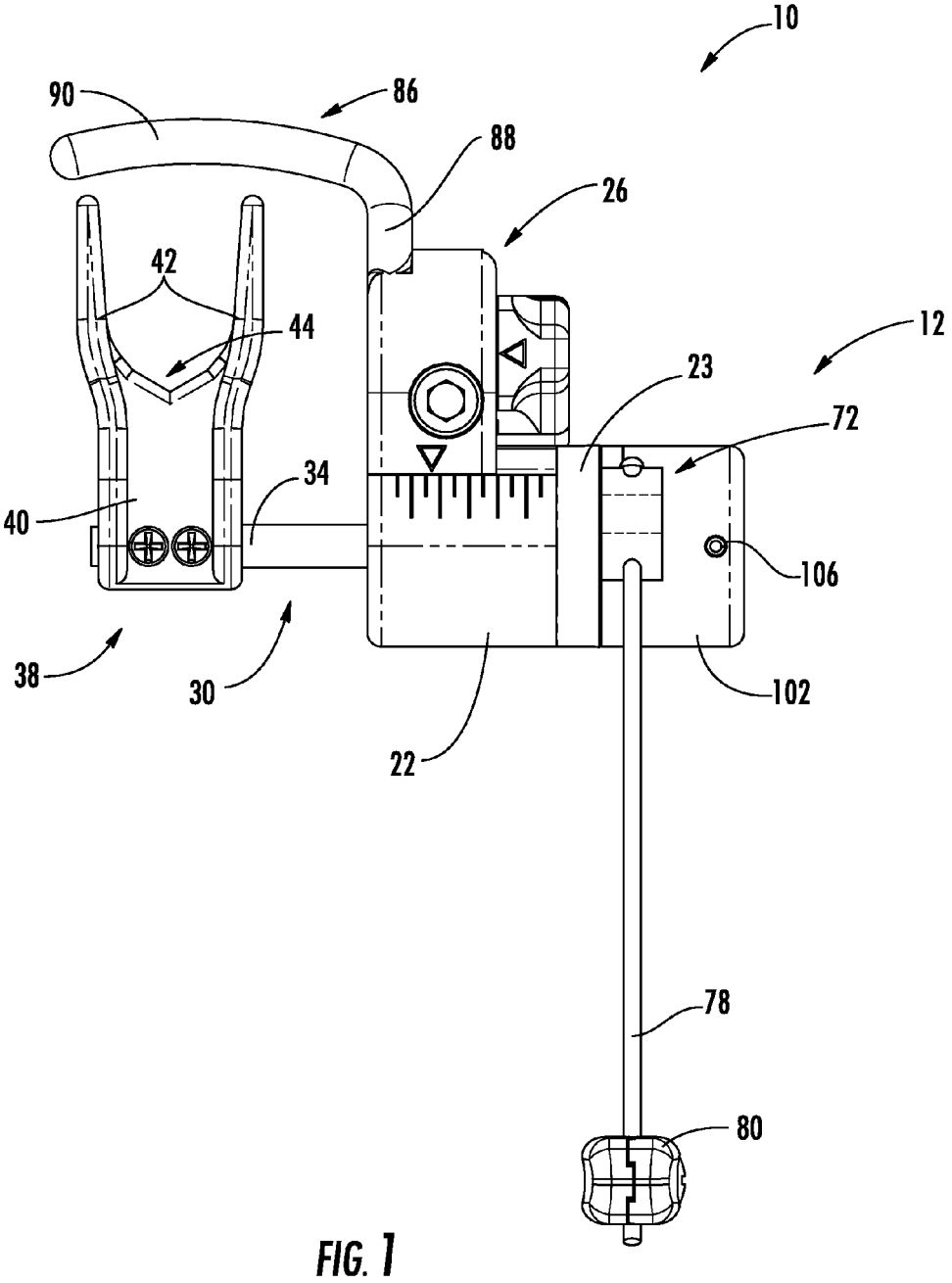
FIG. 1 is a front elevational view of a drop away arrow rest system with a delayed release mechanism, wherein a rest is shown in a cocked position.
Figure 2:
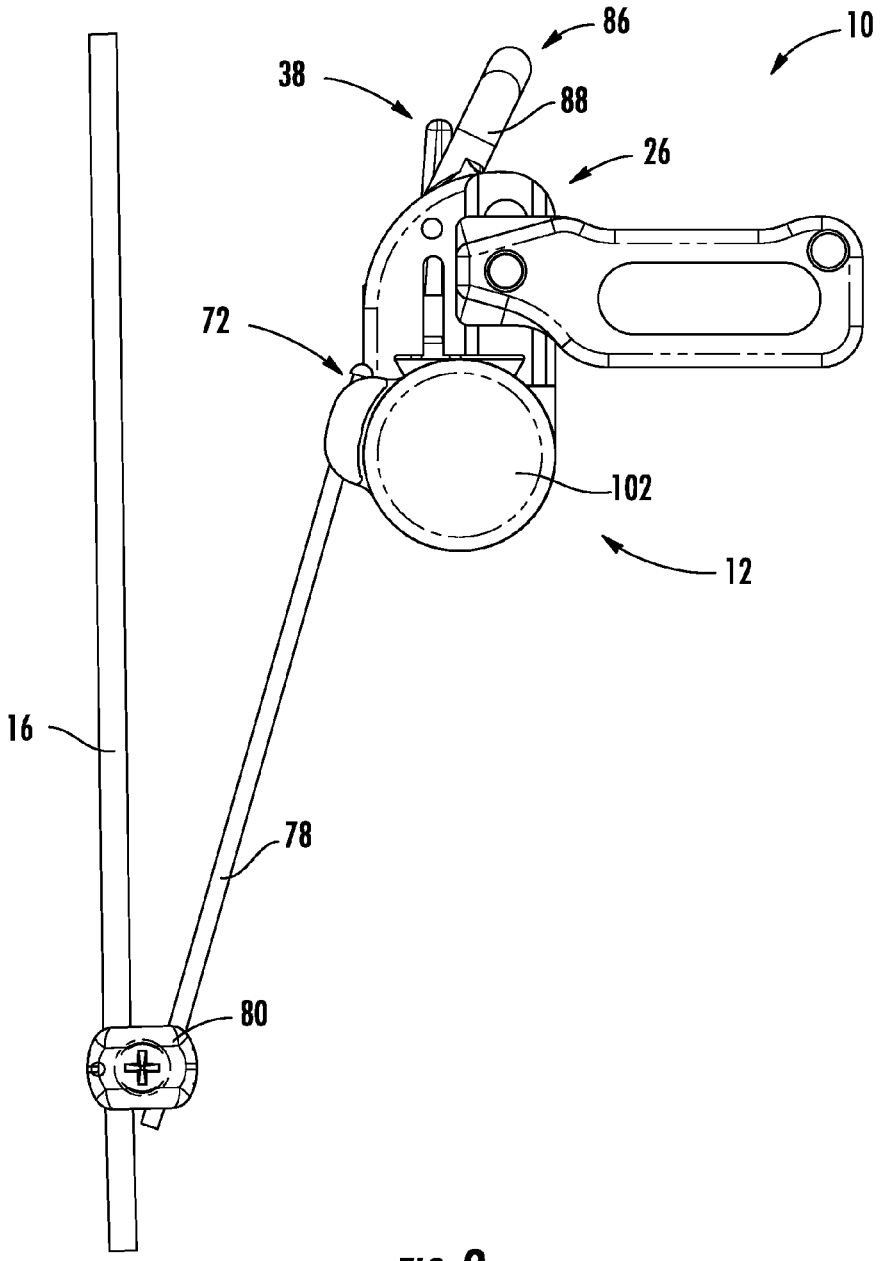
FIG. 2 is a reduced scale right side elevational view of the system and the mechanism shown in FIG. 1.

Referring now to the drawings, there is illustrated an exemplary drop away arrow rest system, generally indicated at 10. The system 10 provides a rest 38 for supporting and containing an arrow (not shown) until the arrow is shot. Shooting the arrow triggers the release of the rest 38 to a drop away position, wherein the rest 38 is out of the path of travel of the arrow.

A delayed release mechanism 12 delays the release of the rest 38 to the drop away position. This is particularly useful on a compound bow, wherein the system 10 is coupled in tension to a cable carried by a cam arrangement to the release of the rest 38 to the drop away position. The mechanism 12 allows the release of the rest 38 to be delayed without exerting too much tension on the cable. Exerting too much tension on the cable could advance the cams, effecting the operation of the bow.

The delayed release mechanism 12 can be used on any suitable drop away arrow rest system. An exemplary system is disclosed in U.S. Pat. No. 6,789,536, issued on Sep. 14, 2004, to Daniel A. Summers, the entire disclosure of which is incorporated herein by reference.

Figure 3:
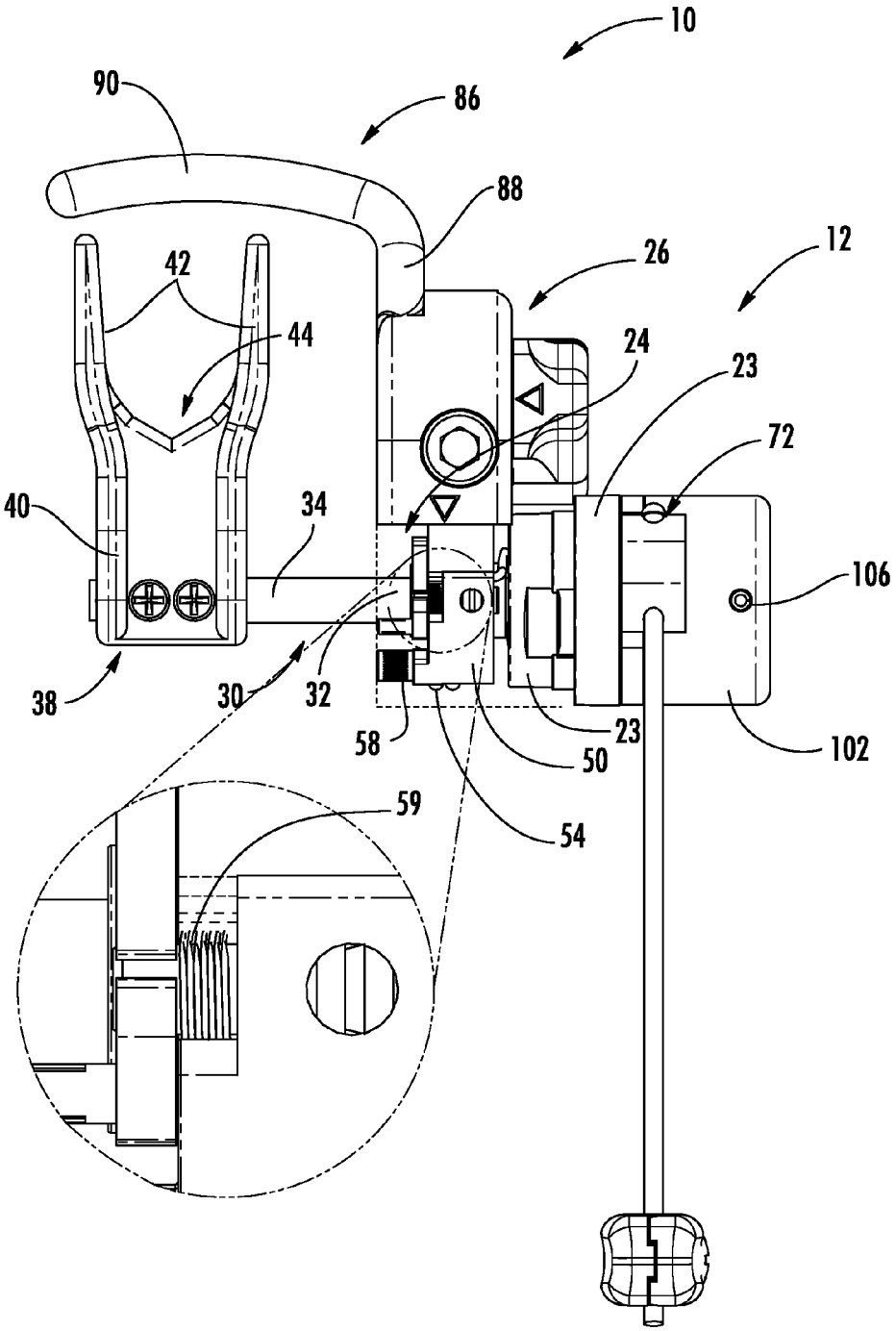
FIG. 3 is a front elevational view of the system and the mechanism shown in FIG. 1 with the housing shown in hidden line to show the housing interior and structure therein, and a detail showing a torsion spring.
Figure 4:
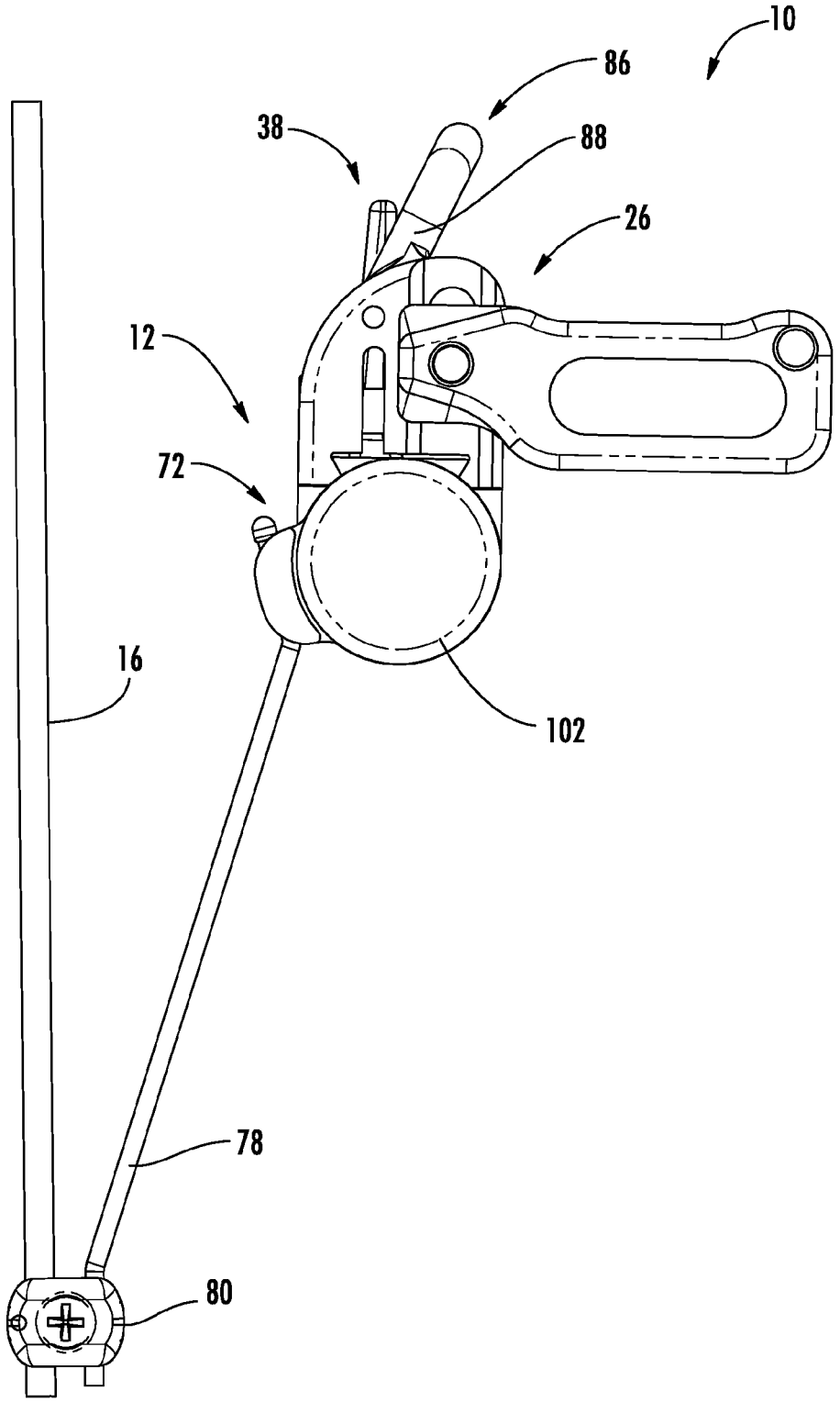
FIG. 4 is a right side elevational view of the system and the mechanism with the rest in an essentially vertical or capture position.
Figure 8:
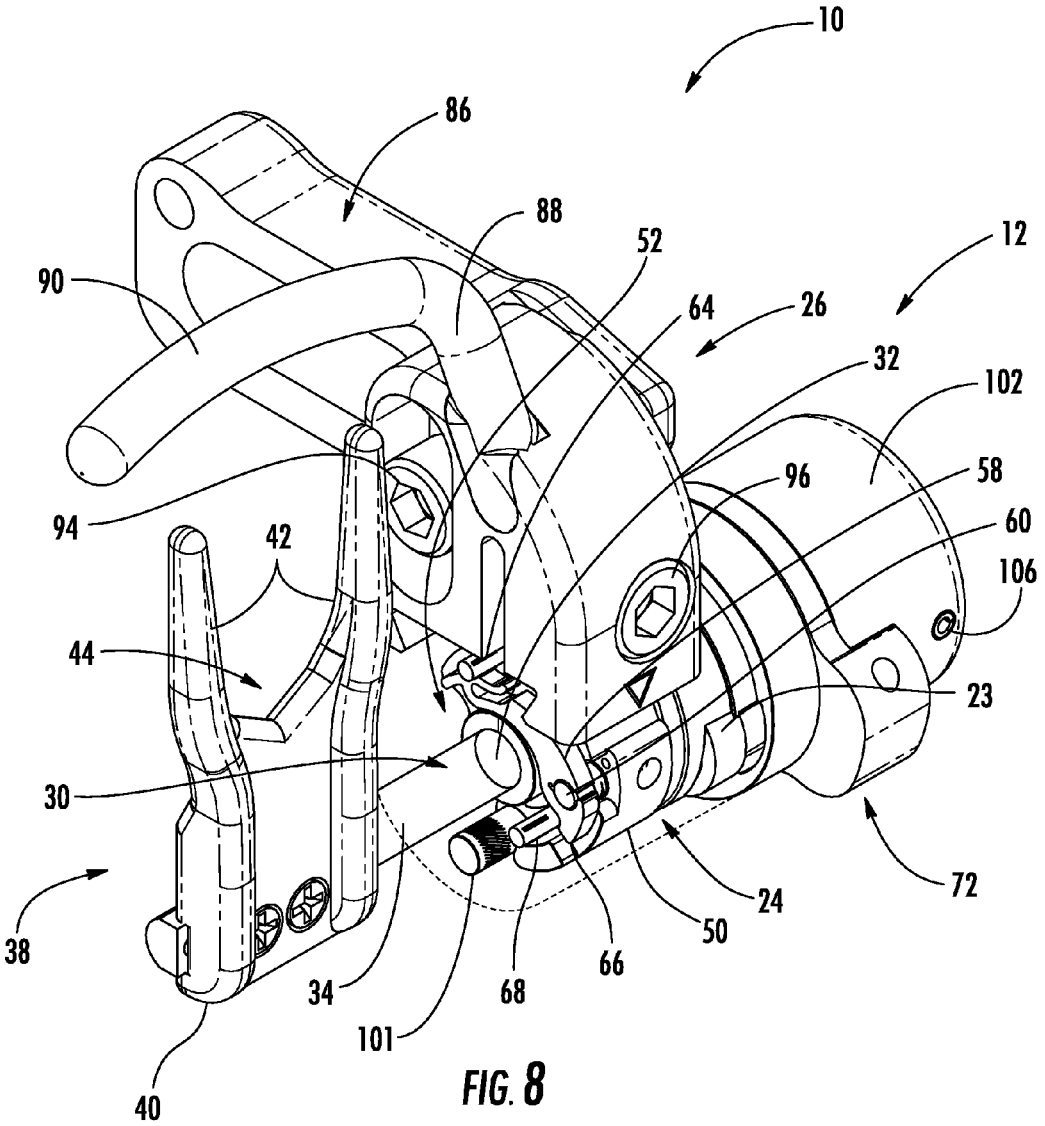
FIG. 8 is an enlarged scale perspective view of the system and the mechanism shown in FIG. 4.
Figure 9:
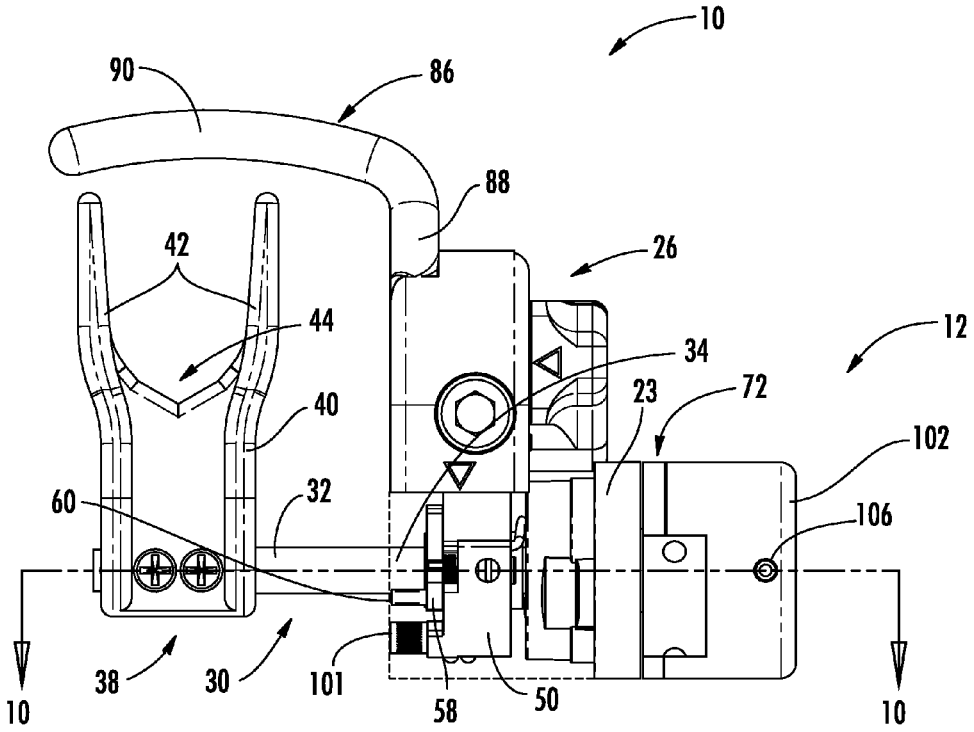
FIG. 9 is an enlarged scale front elevational view of the system and the mechanism shown in FIG. 4 with the housing shown in hidden line to show the housing interior and structure therein.
Figure 10:
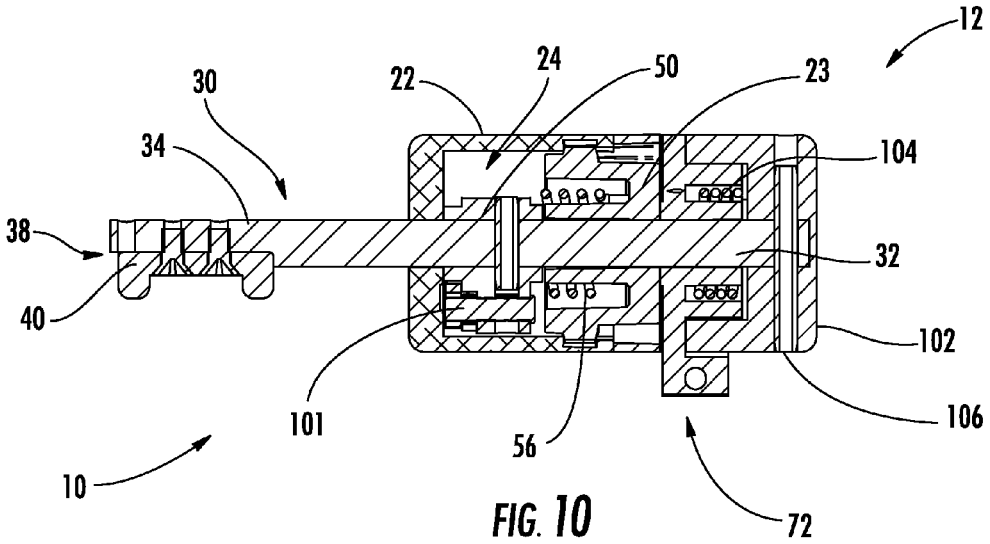
FIG. 10 is a cross-sectional view of the system and the mechanism taken along line 10-10 in FIG. 9.
Figure 11:
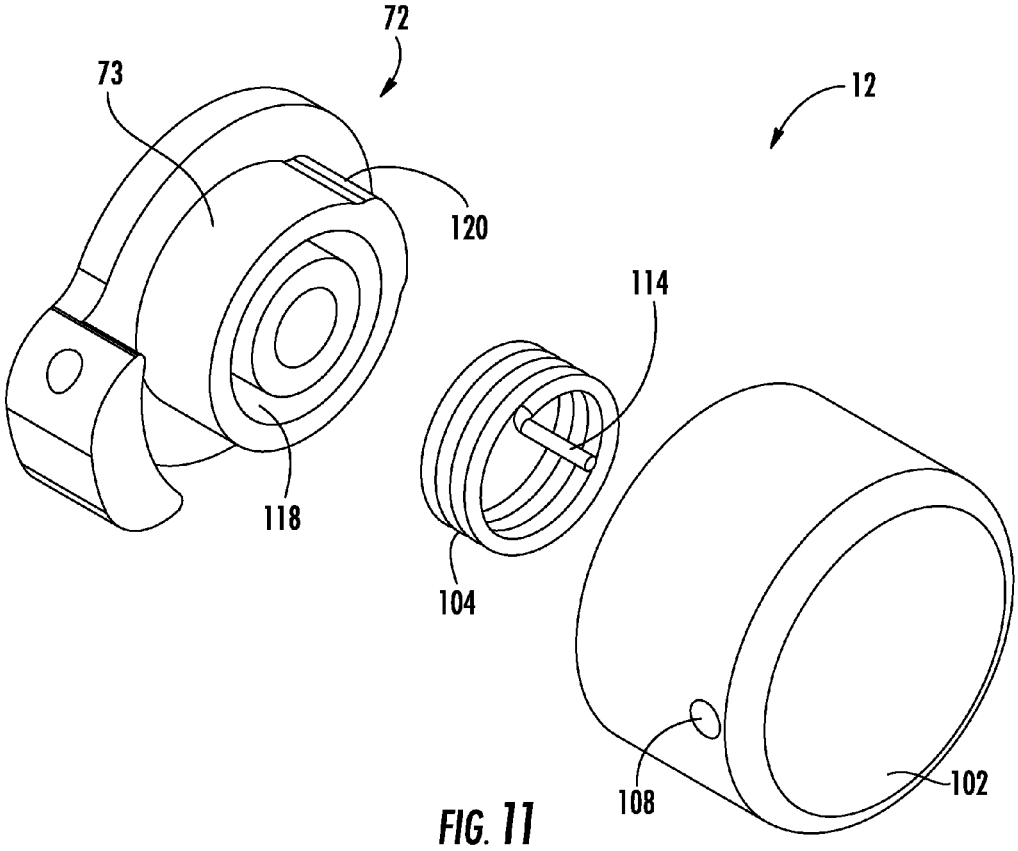
FIG. 11 is an enlarged scale exploded perspective view of the mechanism taken from the right side.
Figure 12:
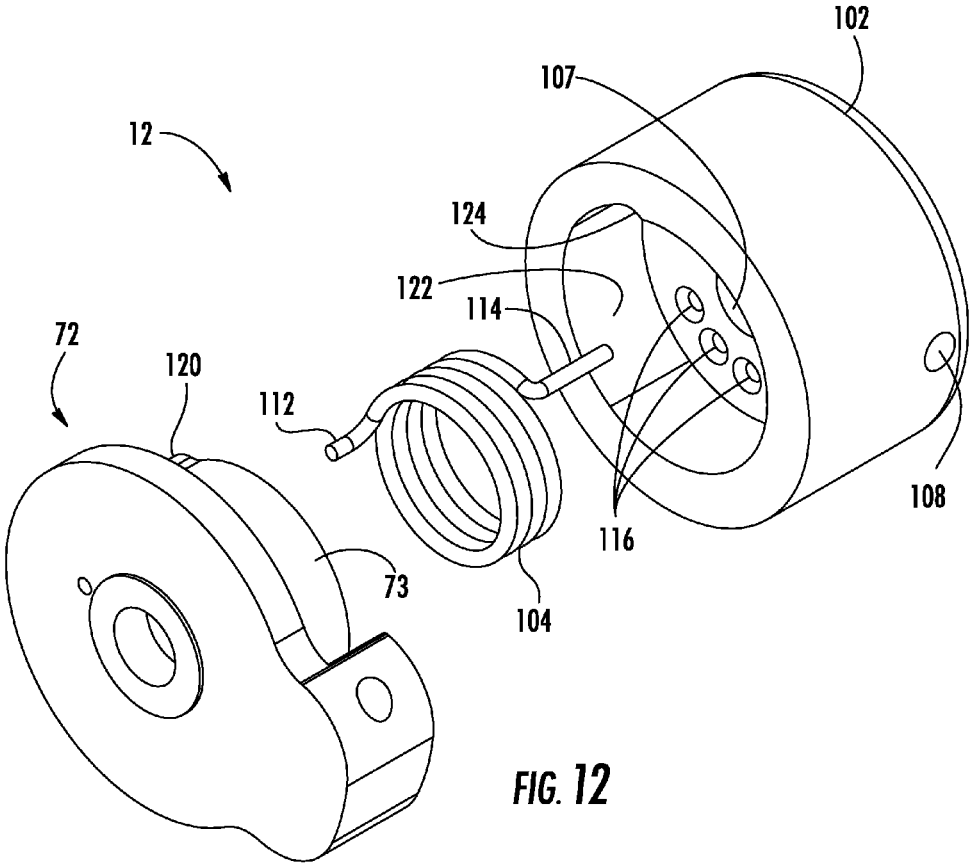
FIG. 12 is an exploded perspective view of the mechanism shown in FIG. 11 taken from the left side.
Figure 13:
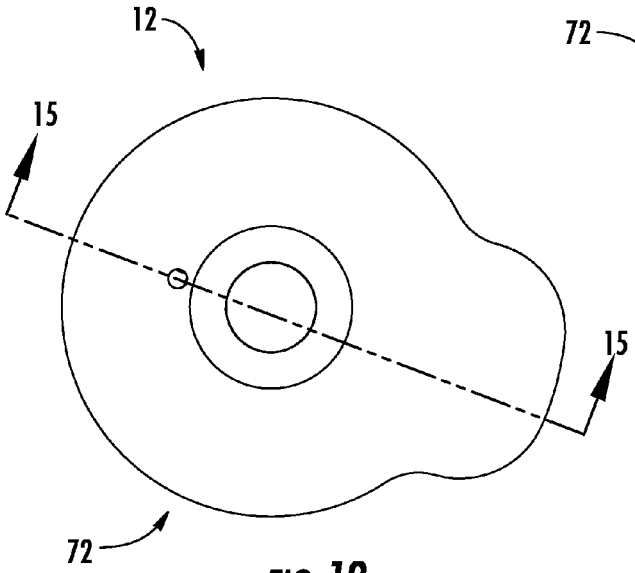
FIG. 13 is an enlarged scale left side elevational view of the mechanism.
Figure 14:
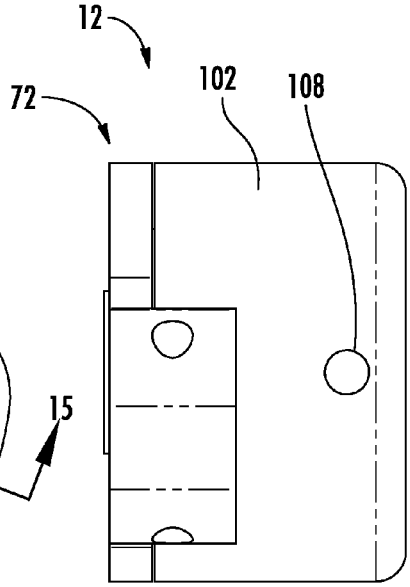
FIG. 14 is a bottom plan view of the mechanism shown in FIG. 13.
Figure 15:
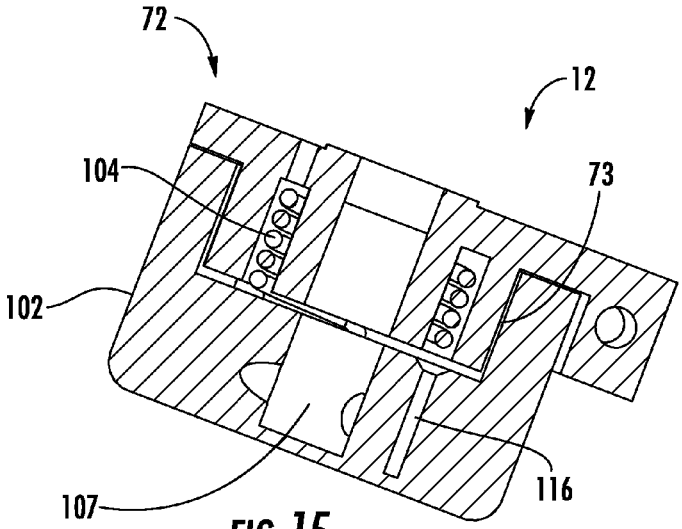
FIG. 15 is a cross-sectional view of the mechanism taken along line 15-15 in FIG. 13.
Figure 16:
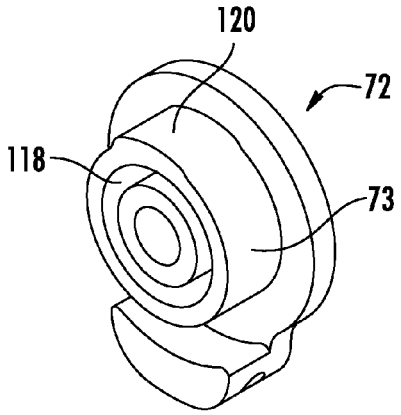
FIG. 16 is a perspective view of a cord lever.
Figure 17:
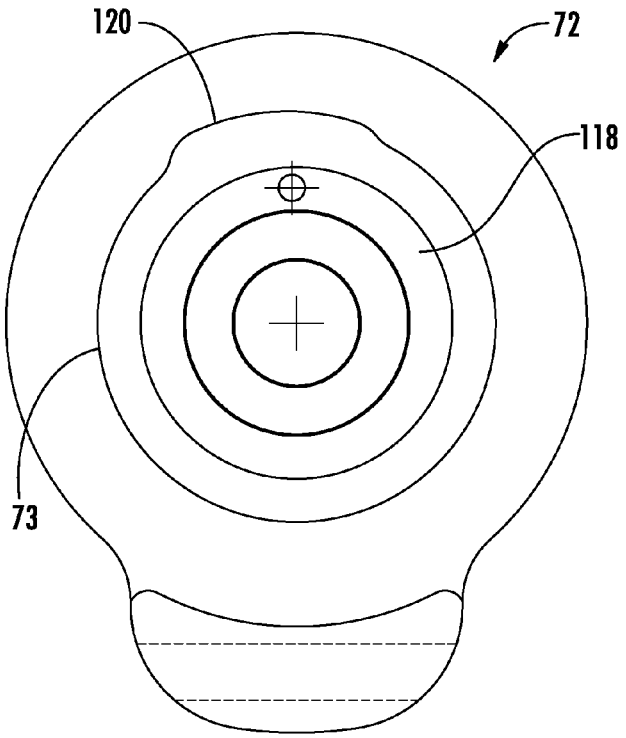
FIG. 17 is an enlarged scale left side elevational view of the cord lever shown in FIG. 16.
Figure 18:
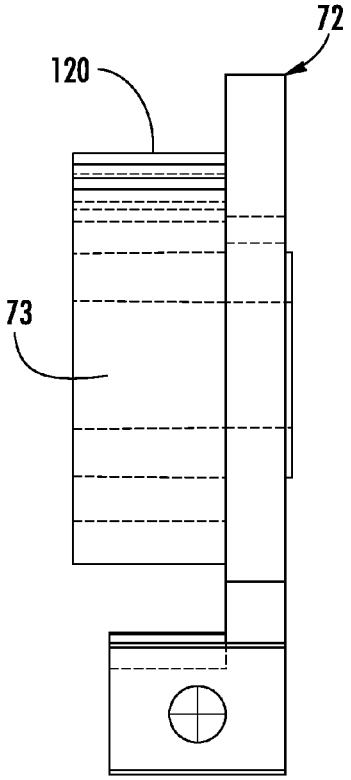
FIG. 18 is a front elevational view of the cord lever shown in FIG. 17.
Figure 19:
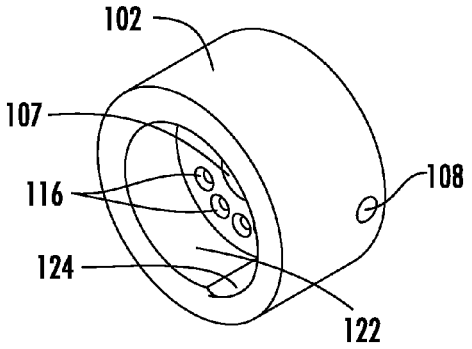
FIG. 19 is a perspective view of an end cap.
Figure 20:
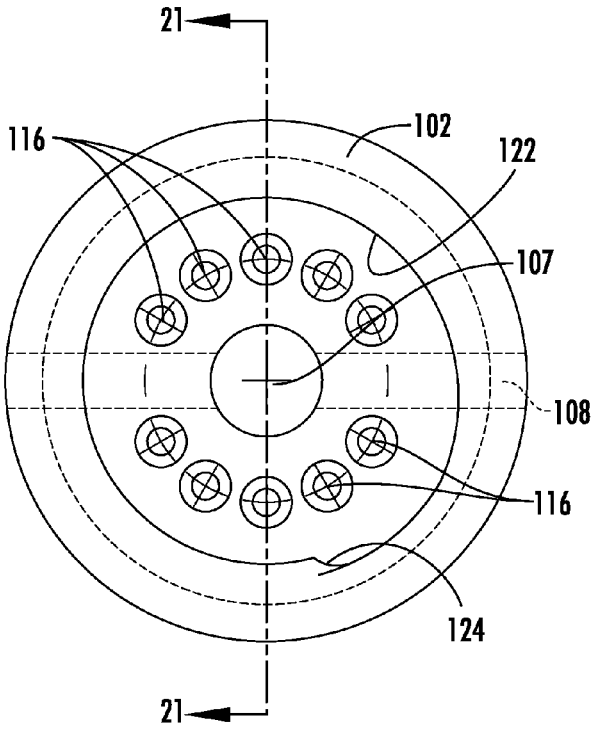
FIG. 20 is an enlarged scale left side elevational view of the end cap shown in FIG. 19.
Figure 21:
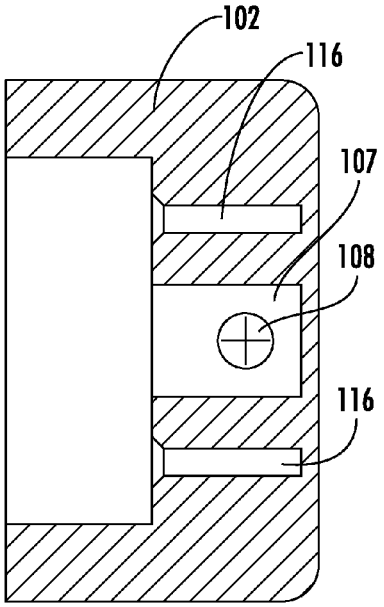
FIG. 21 is a cross-sectional view of the end cap taken along line 21-21 in FIG. 20.

As shown throughout the drawings, the system 10 includes a housing 22 having a hollow interior 24 (shown in FIGS. 3, 8 and 10) and coupling components 26 for coupling the housing 22 to the bow.

A shaft 30 has an interior segment 32 (shown in FIGS. 3, 8 and 10) that is rotatably supported within the housing 22. An exterior segment 34 extends to the exterior of the housing 22, so that it may be oriented beneath the arrow and transverse to its path of travel.

The rest 38 is supported in relation to the exterior segment 34 of the shaft 30. An exemplary rest 38, which is shown in the drawings, is in the form of a Y-shaped rest having a leg 40 supporting two laterally spaced arms 42 between which is a V-shaped surface 44 upon which the arrow may be positioned when the arrow is loaded and until it is fired. The V-shaped surface 44 supports the arrow when drawing and releasing the bow string. The leg 40 is supported by the exterior segment 34 of the shaft 30 for the rotation of the rest 38 concurrent with the rotation of the shaft 30. It should be appreciated that the illustrated rest 38 is an exemplary rest and that the system 10 may employ other suitable rests.

Figure 7A:
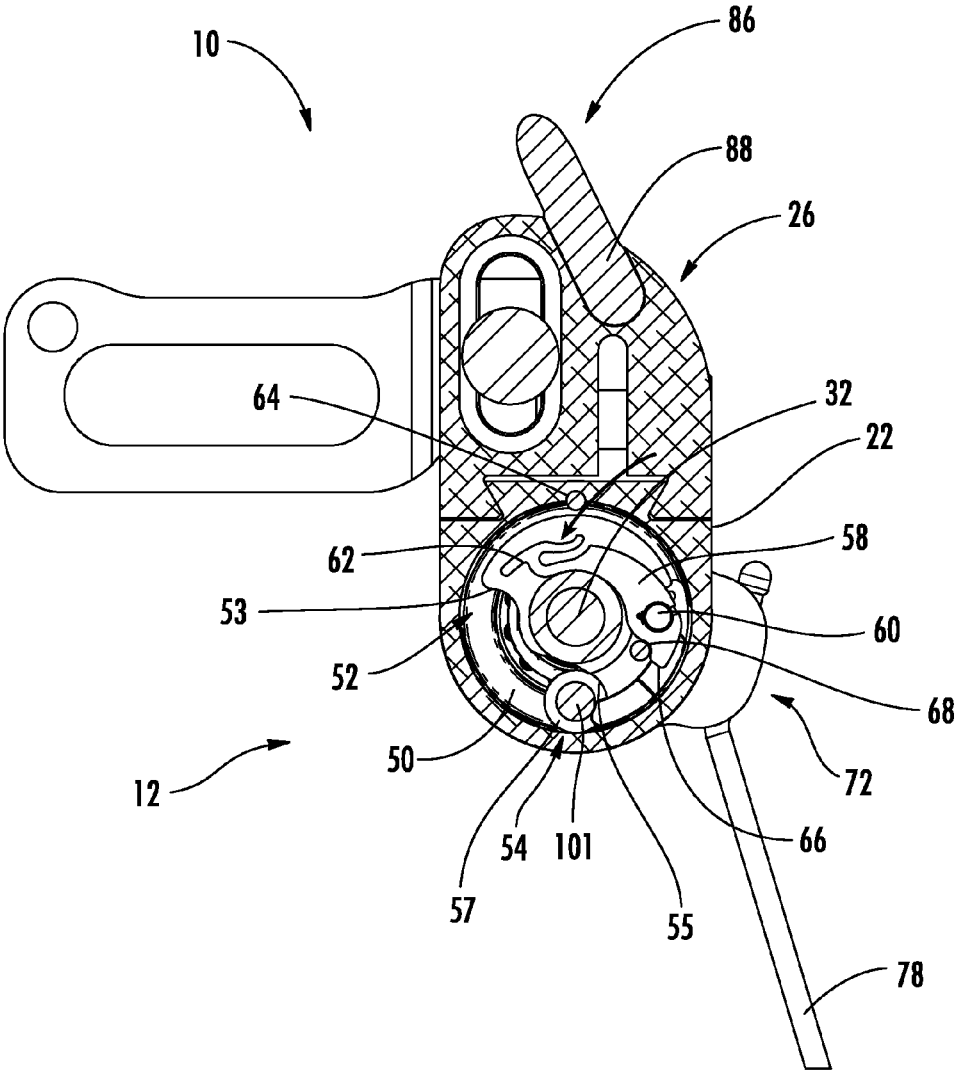
FIG. 7A is an enlarged scale cross-sectional view of the system and the mechanism taken along line 7-7 in FIG. 6.

An oscillator 50 is located within the housing 22. The oscillator 50 is mounted for rotation with the shaft 30. The oscillator 50 has an arcuate recess 52 (shown in FIGS. 7A-C), which extends 90 degrees relative to the rest 38, although other angles of extent may be suitable for the system 10. The recess 52 has arcuate ends 53, 55, which cooperate with a stop 54.

Figure 5A:
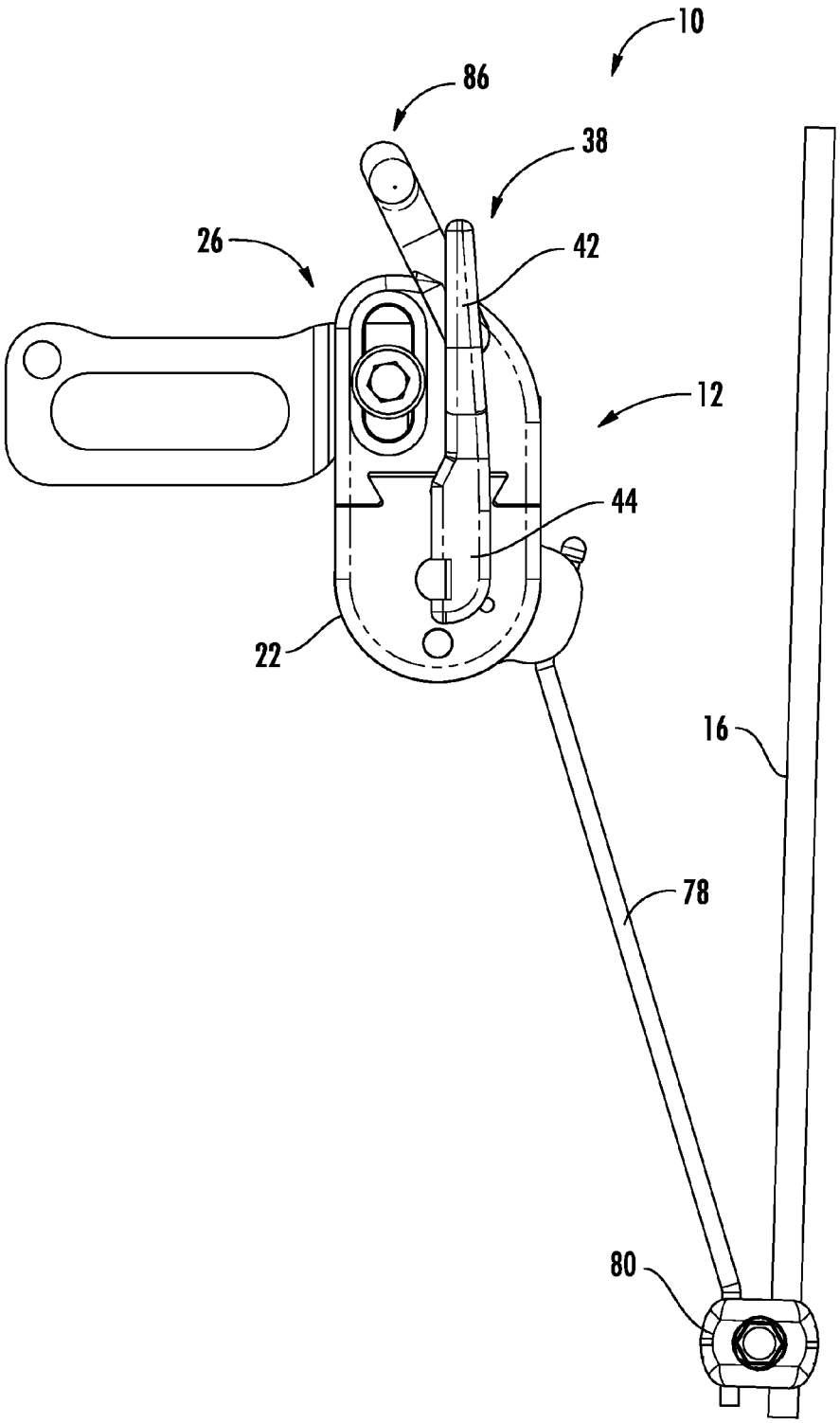
FIG. 5A is a left side elevational view of the system and the mechanism shown in FIG. 4.
Figure 5B:
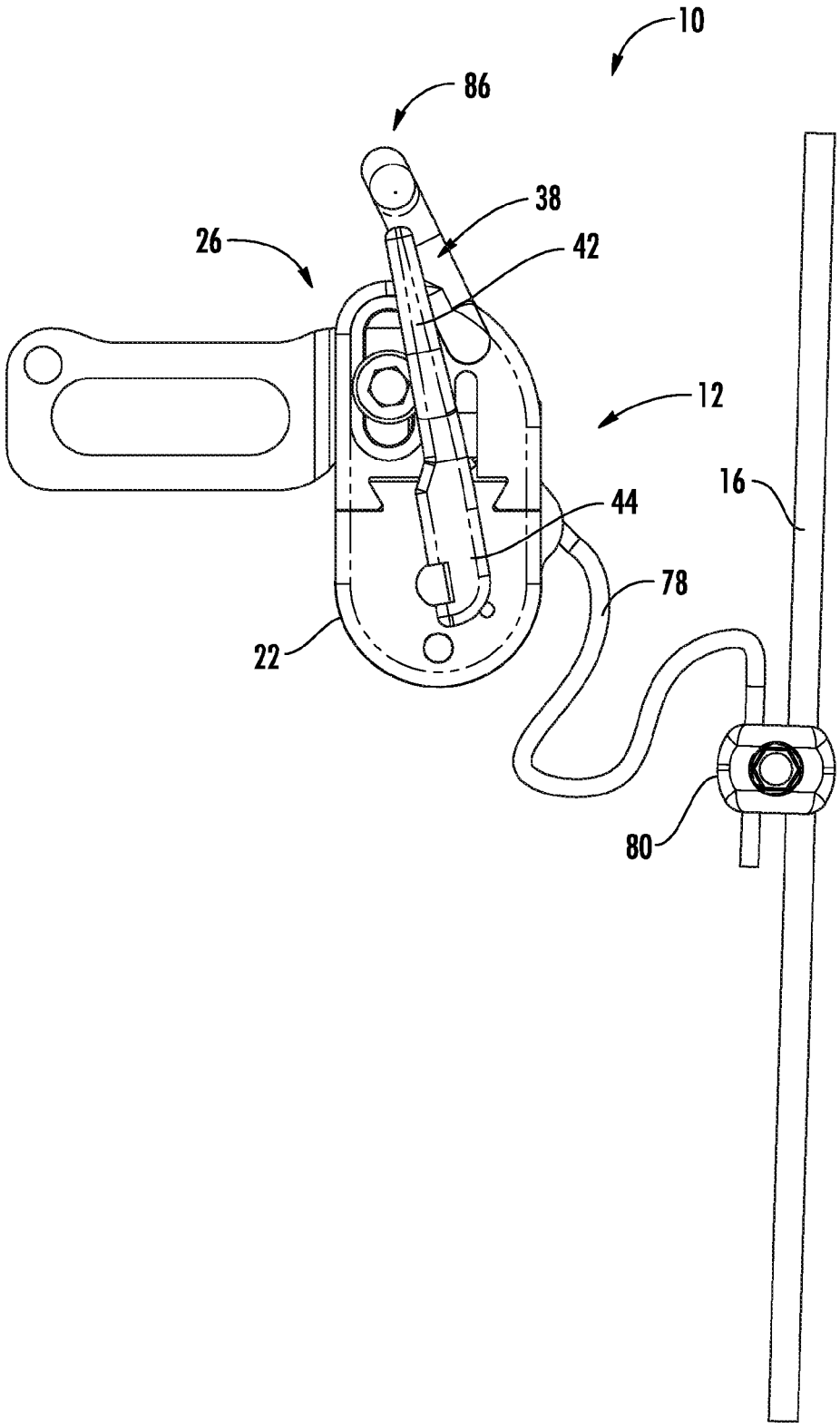
FIG. 5B is a left side elevational view of the system and the mechanism in cocked position.
Figure 5C:
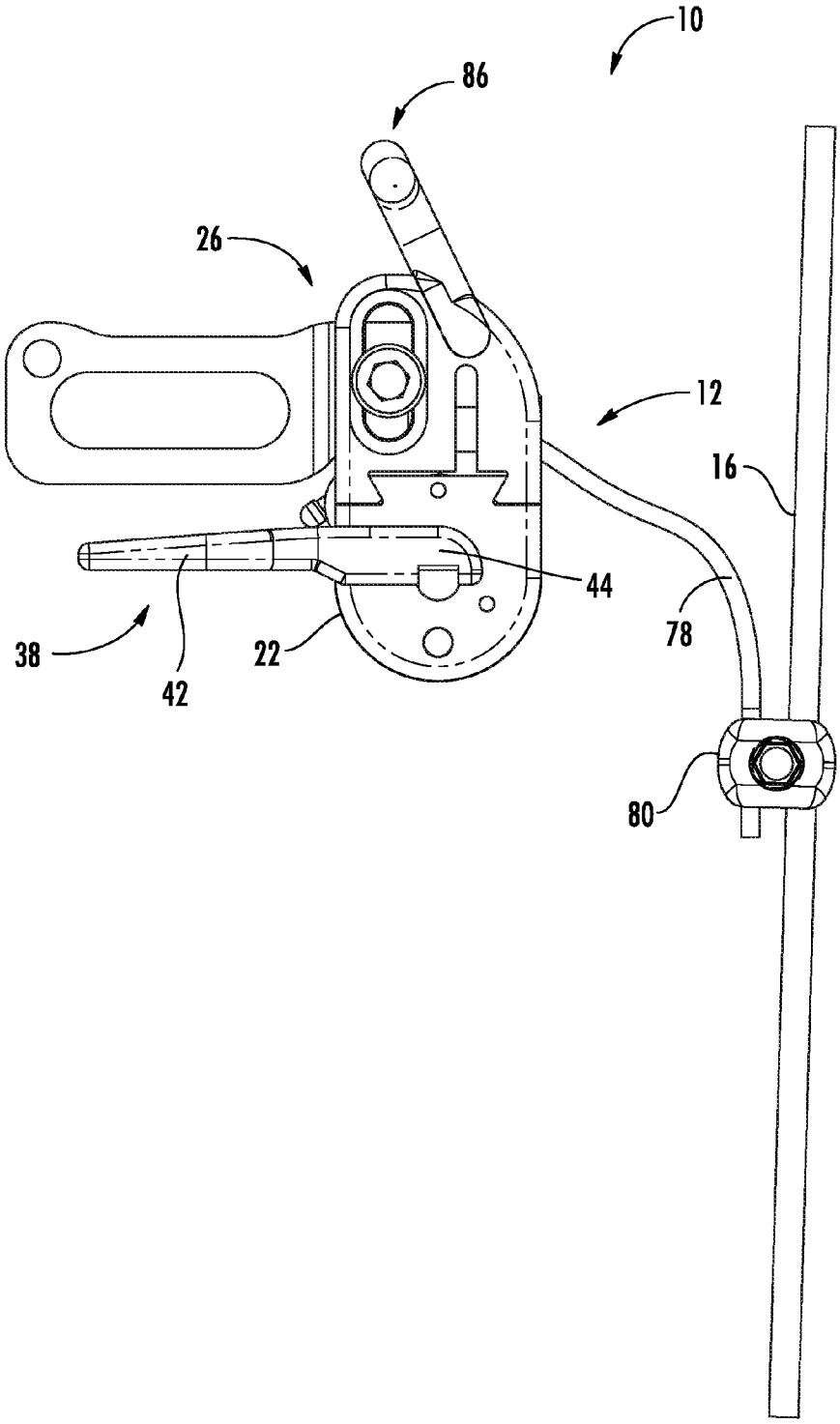
FIG. 5C is a left side elevational view of the system and the mechanism in a drop away position.
Figure 6:
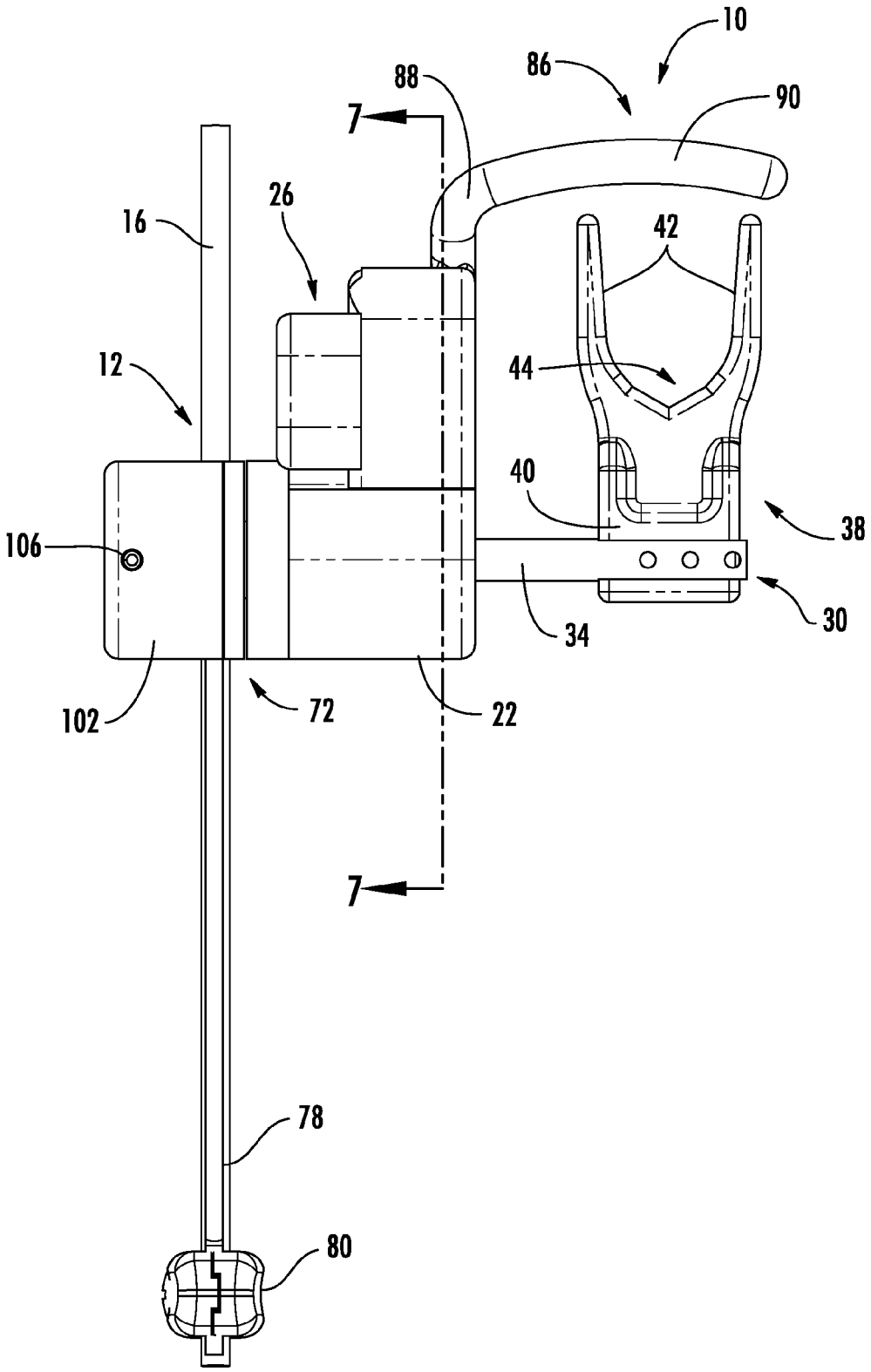
FIG. 6 is a left side elevational view of the system and the mechanism shown in FIG. 4.

The stop 54 is located within the housing 22 between the ends 53, 55 of the recess 52. The stop 54 is fixedly supported in relation to the housing 22 adjacent the rest 38. The stop 54 acts to limit the rotation of the oscillator 50. One end 53 of the oscillator 50 cooperates with rubber bumpers 57 on a stop pin 101 to decelerate the rest 38 and reduce the risk that the rest 38 will bounce back when the rest 38 drops at full velocity to the drop away position (shown in FIG. 5C).

A coil spring 56 (shown in FIG. 10) has a first end fixedly coupled to an end cap 23, a component of the housing 22 remote from the rest 38. A second end of the coil spring 56 is coupled to the oscillator 50. The coil spring 56 acts to rotate the oscillator 50 to drop the rest 38 when firing an arrow.

A dog 58 is mounted to pivot on a pivot pin 60, which is secured to the oscillator 50. A torsion spring 59 (shown in detail in FIG. 3) is carried by the pivot pin 60. The torsion spring 59 functions to urge the dog 58 to a cocked position (shown in FIG. 7B). The dog 58 has a head 62 that functions as a spring, which cooperates with a fixed intermediate locking pin 64 when the dog 58 is in the cocked position to hold the oscillator 50 and the rest 38 in a cocked position. The dog 58 also has a tail 66 that functions to cooperate with a fixed ramp pin 68 to rotate the dog 58 (e.g., in a counterclockwise direction, as shown by the directional arrow in FIG. 7A) and hold the dog 58 when the oscillator 50 and the rest 38 are rotated to a capture position (e.g., the essentially vertical position clearly shown in FIG. 5A).

The dog 58 may be fabricated of spring steel or other suitable material, and is configured to provide a break away feature whereby, if an arrow is shot through the rest 38 and the timing is incorrect by improper installation, the dog 58 will spring and allow the rest 38 to drop away without damage.

Figure 23:
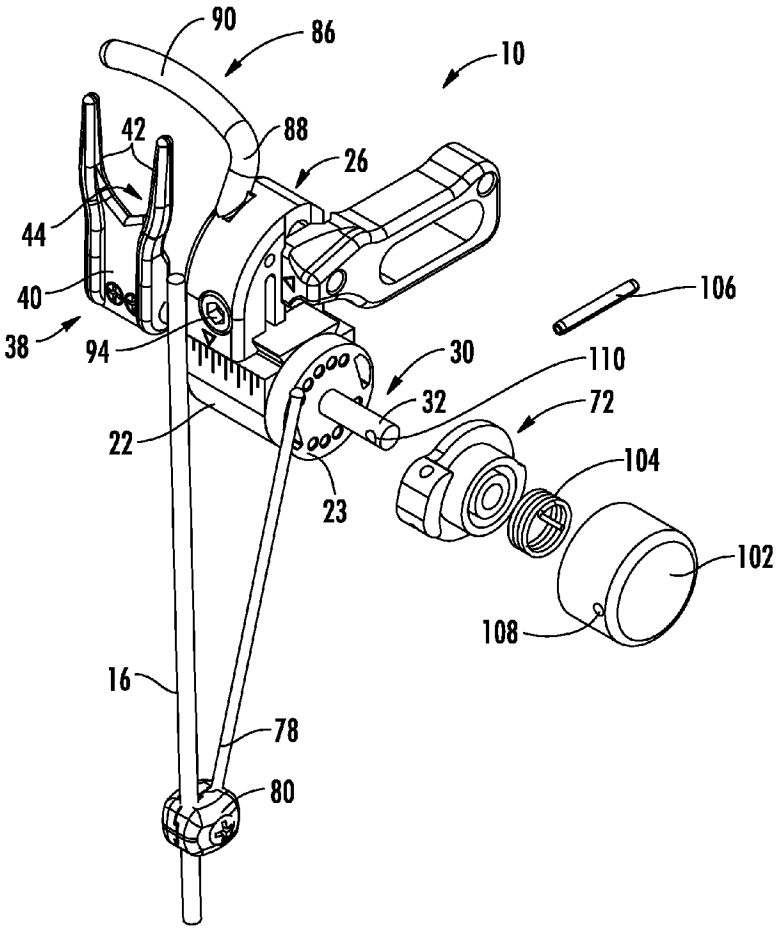
FIG. 23 is a partially exploded perspective view of the system and the mechanism shown in FIG. 22.
Figure 22:
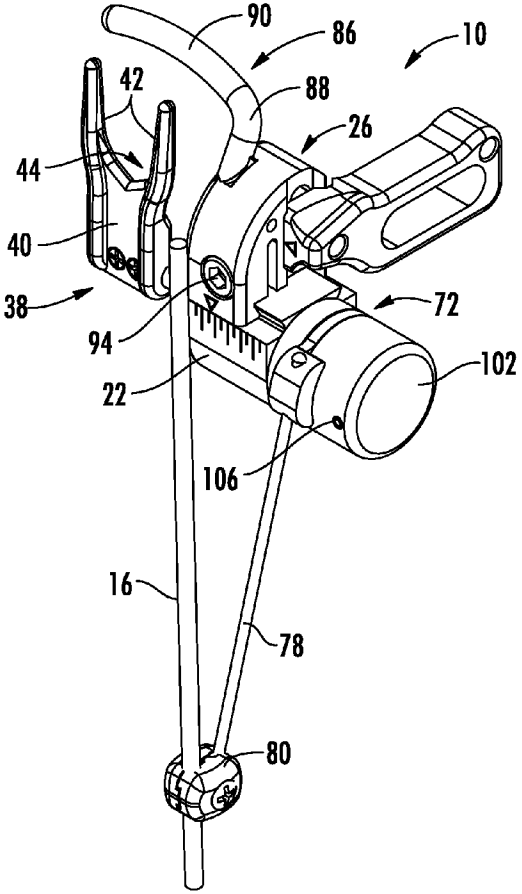
FIG. 22 is a reduced scale perspective view of the system and the mechanism shown in FIG. 1.
Figure 25:
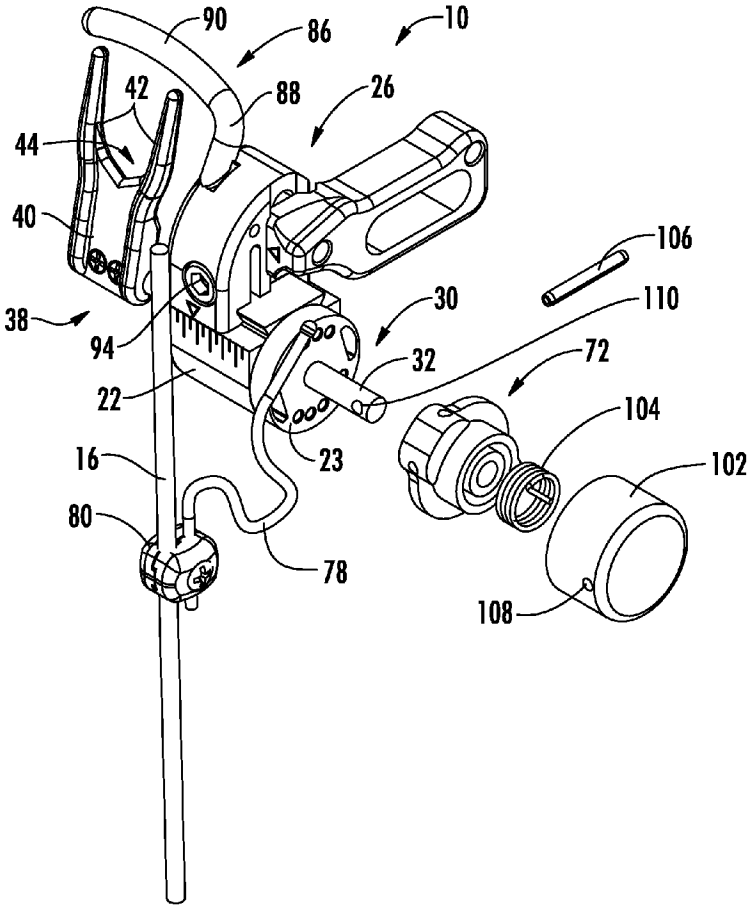
FIG. 25 is a partially exploded perspective view of the system and the mechanism shown in FIG. 24.
Figure 24:
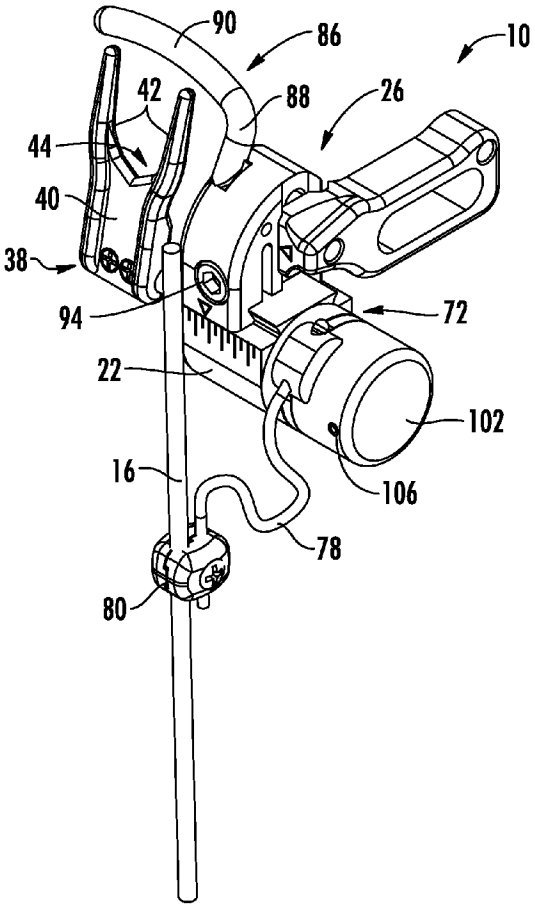
FIG. 24 is a perspective view of the system and the mechanism shown in FIG. 22 with the rest in the capture position.
Figure 27:
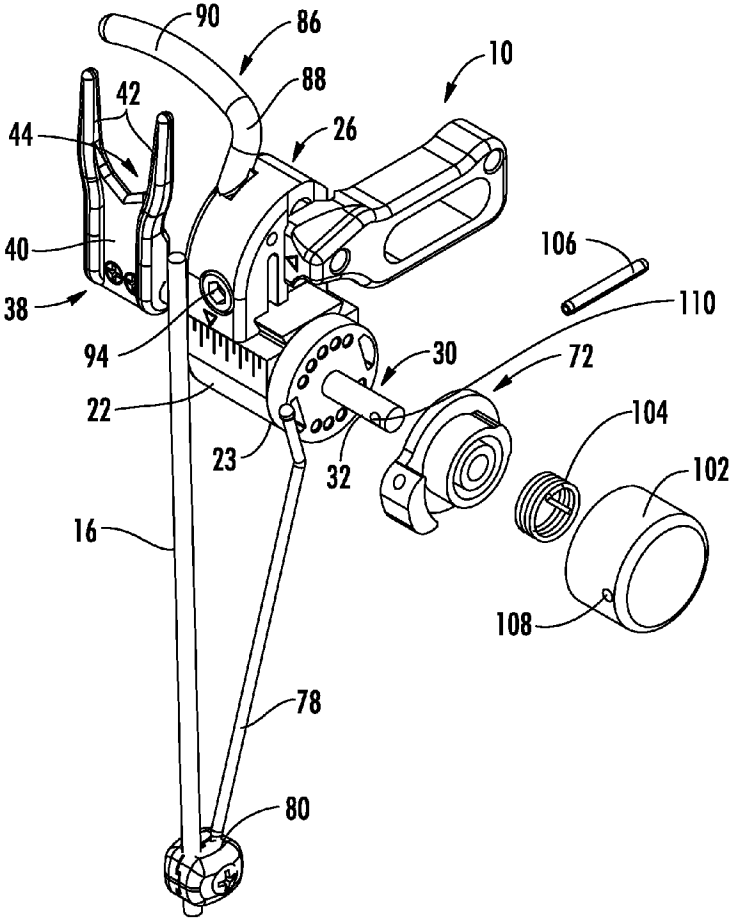
FIG. 27 is a partially exploded perspective view of the system and mechanism shown in FIG. 26.
Figure 26:
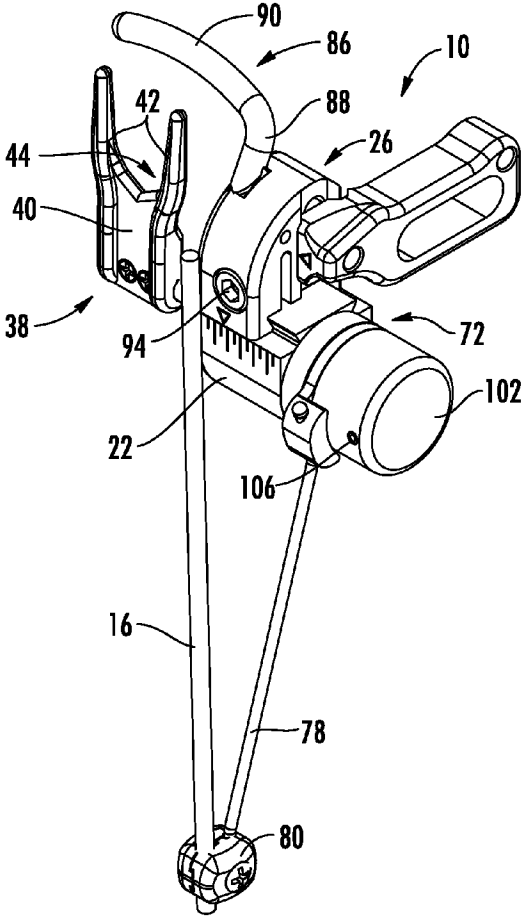
FIG. 26 is a perspective view of the system and the mechanism shown in FIG. 22 with the rest in the capture position and the cord lever further rotated to load a torsion spring.

A cord lever 72 is mounted on the end of the shaft 30 remote from the rest 38 for rotation with the shaft 30. The cord lever 72 may be provided with a radially extending thumb lever (not shown) for rotation by the user to rotate the shaft 30 and the rest 38 to the cocked position (shown in FIGS. 5B and 22-23).

Figure 29:
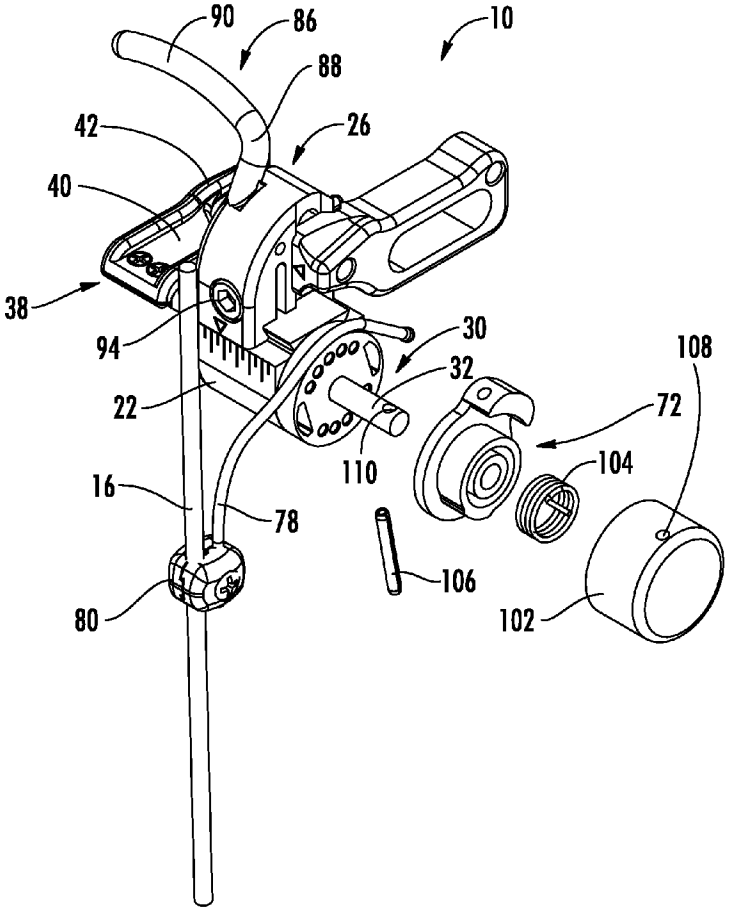
FIG. 29 is a partially exploded perspective view of the system and mechanism shown in FIG. 28.
Figure 28:
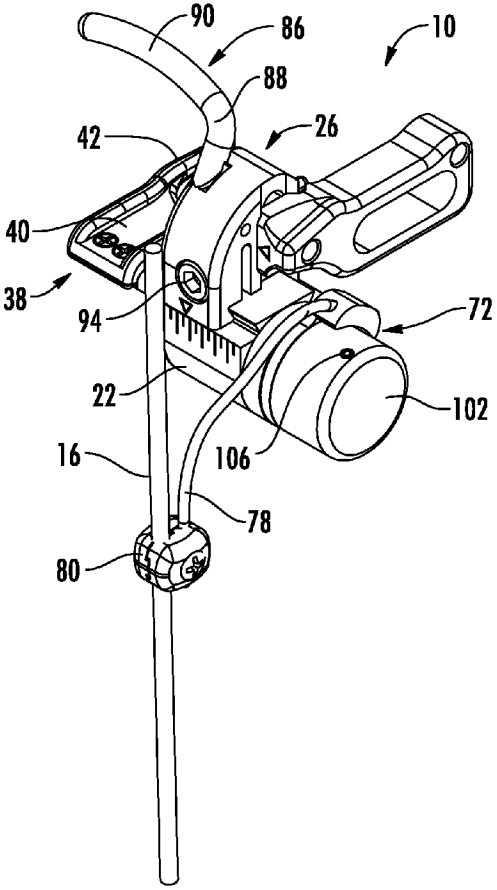
FIG. 28 is a perspective view of the system and mechanism shown in FIG. 22 with the rest down in the drop away position.
Figure 30:
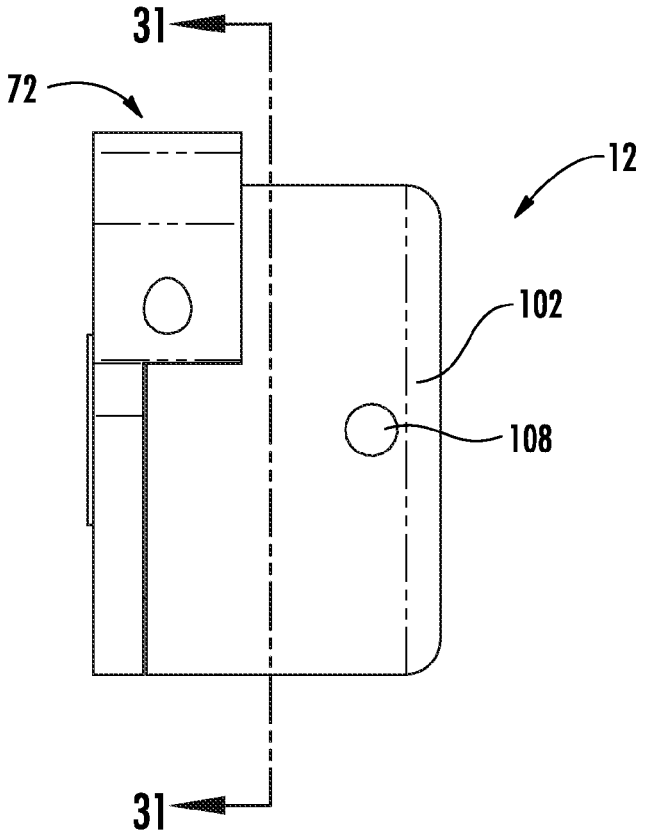
FIG. 30 is an enlarged front elevational view of the mechanism shown in FIG. 22.
Figure 31:
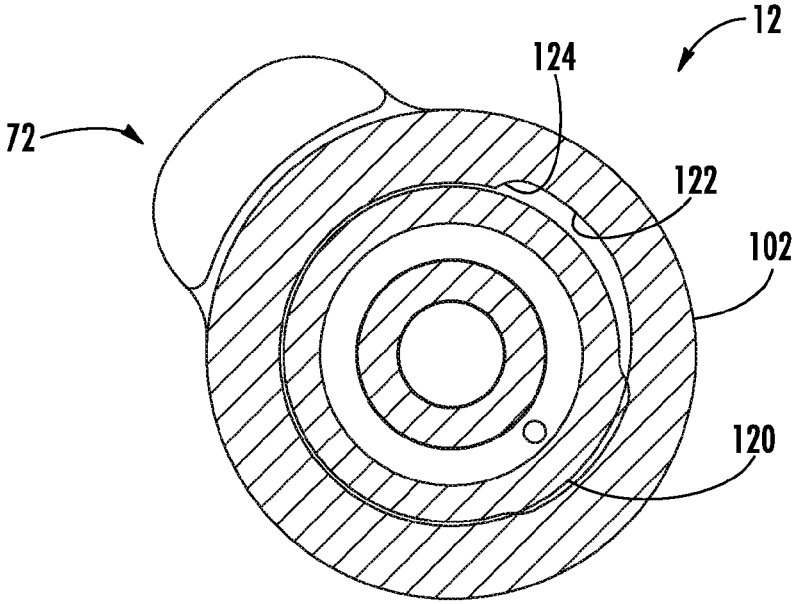
FIG. 31 is a cross-sectional view of the mechanism taken along line 31-31 in FIG. 30.
Figure 32:
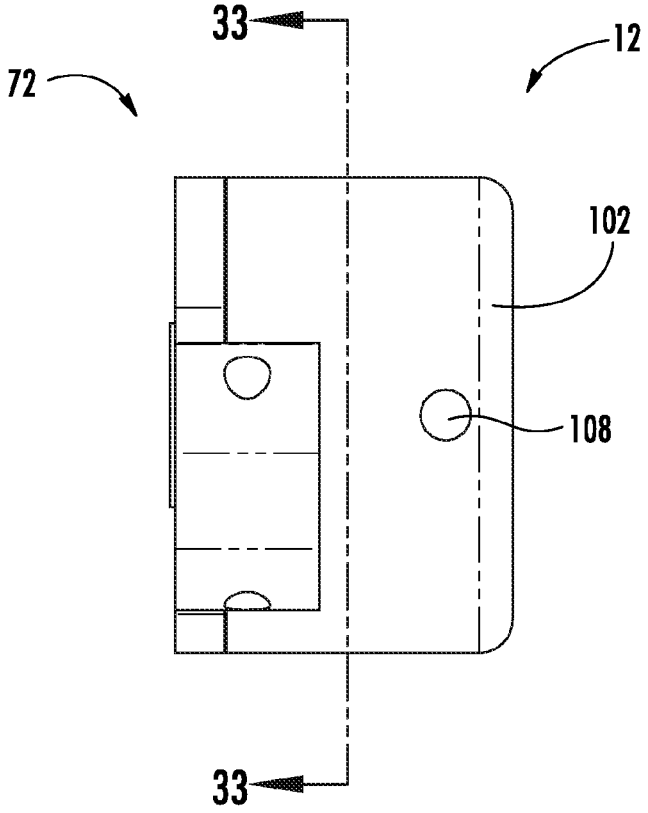
FIG. 32 is an enlarged front elevational view of the mechanism shown in FIG. 26.
Figure 33:
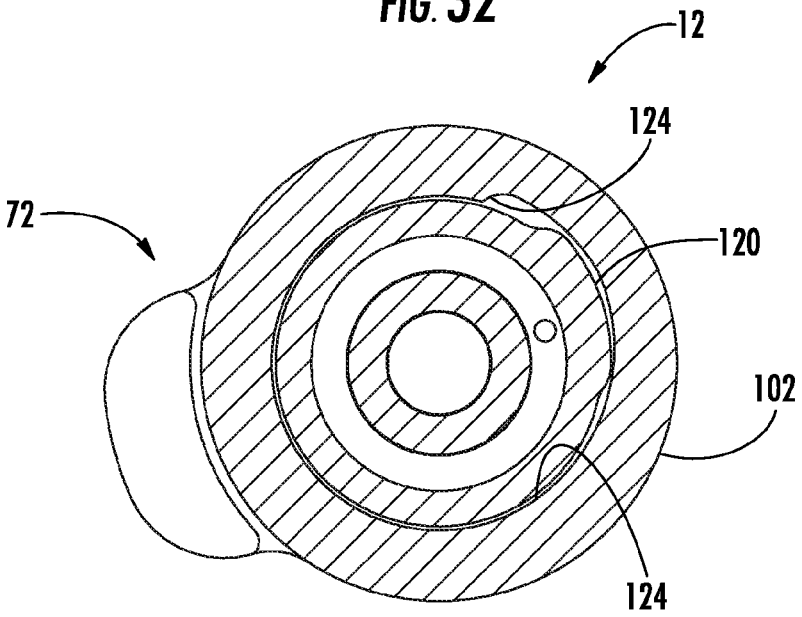
FIG. 33 is a cross-sectional view of the mechanism taken along line 33-33 in FIG. 32.

A cord 78 has a first end secured to the cord lever 72 and a second end with a coupling 80 coupled between the cord 78 and the bow string 16, or cable in the case of a compound bow. In this manner, pulling the string 16 will pull the cord 78 and rotate the cord lever 72 and the shaft 30 and the rest 38 (e.g., in a clockwise direction when viewing FIG. 5A) from the cocked position to the capture position shown in FIGS. 5A and 24-26. Further, release of the string will rotate the shaft 30 and the rest 38 (e.g., in a counterclockwise direction when viewing FIG. 5C) from the capture position to an essentially horizontal or drop away position, shown in FIGS. 5C and 28-29.

A containment bar 86, which is horizontally oriented when viewing the drawings, has a fixed end 88 that is secured to a vertical component 25 of the housing 22. The fixed end 88 has an intermediate region 90, which is positioned over and in proximity to the laterally spaced arms 42 of the rest 38. In this manner, an arrow on the rest 38 is prevented from falling away and remains contained when hunting, drawing or during slow let down.

Clamping screws 94, 96 are operatively coupled between the housing 22 and the rest 38 to accommodate fine tuning of the rest 38 for optimum arrow flight.

The delayed release mechanism 12 includes a cap 102 that is operatively connected to the cord lever 72 via a torsion spring 104 (shown in FIGS. 10-15). The cap 102 is fixed in relation to an end of a shaft 30 by a pin 106 or other suitable fastener. To conserve space, and thus provide a more compact mechanism, the cord lever 72 may be provided with an annular channel 118 for receiving the torsion spring 104. This provides a more compact mechanism. The annular channel 118 should be sufficiently sized to permit torque to be applied and released from the torsion spring 104.

As shown in FIGS. 11-21, the cord lever 72 has a hole through which the shaft 30 passes. The shaft 30 extends beyond the cord lever 72 and engages a socket 107 in the cap 102. The socket 107 aligns axially with the shaft 30 and extends along the axis of the cap 102. A hole 108 extends transversely through the cap 102. The hole 108 through the cap 102 aligns with a transverse hole 110 in the end of the shaft 30. The pin 106, which may be in the form of a roll pin, extends through the aligned holes 108, 110 to fix the cap 102 in relation to the shaft 30 so that the cap 102 rotates with the shaft 30. As stated above, other suitable fasteners, including a threaded fastener, may be employed in lieu of the pin 106.

The torsion spring 104 may be in the form of a helical spring having a first finger 112 at one end that cooperates with a hole in the cord lever 72 and a second finger 114 at an opposing end that cooperates with a hole 116 in the cap 102. The cap 102 may include a plurality of holes 116 arranged in a circular pattern within the cap 102 at the end of the cap 102 coaxially about the axis of the cap 102. The torsion spring 104 may be pre-loaded with torque by inserting the finger 114 in any one of the desired holes 116. Twisting the torsion spring 104 (i.e., end 114 in a clockwise direction when viewing FIG. 11) pre-loads the torsion spring 104 (i.e., increases the torque applied by the torsion spring 104). The torque of the torsion spring 104 should have a greater value than that of the main coil spring 56 so that rotation of the cord lever 72 or cap 102 effects twisting of the main coil spring 56 and rotation of the oscillator 50 to cause rotation of the shaft 30 and the rest 38.

An adjustable timing feature may allow the rest 38 to drop away at different points of travel along an arrow shaft being shot from the bow. The adjustment may be provided by varying cord tension between the bow string 16 and the cord lever 72. Increasing the tension between the bow string 16 and coupling 80 causes the cord lever 72 to continue rotating past the point where the rest 38 is in the capture position until bow is fully drawn. At the point in time when the arrow is released, the rest 38 remains in the capture position, allowing the arrow shaft to travel along the rest 38, supported by or touching the rest 38. The mechanism 12 (i.e., the torsion spring 104) is adjustable to trigger the rest 38 to rotate to the drop away position out of the way of the arrow and clear arrow fletching. By further rotating the cord lever 72 via the provision of the torsion spring 104 and the cap 102, the mechanism 12 further delays the release of the rest 38 to a drop away position for a period of time (i.e., several milliseconds) after the arrow is shot, thus providing prolonged support for the arrow after the arrow is shot. This increases the accuracy of the shot.

The cord lever 72 may be provided with a reduced diameter or dimension portion 73 that is dimensioned to fit within the cap 102. A radially extending projection 120 extends from the portion 73. The radially extending projection 120 cooperates with a cam surface 122 within the cap 102, and defined by an inner wall of the cap 102 to function to dampen the relative movement of the cord lever 72 and the cap 102. The cap 102 may also be provided with a stop 124 at one end of the cam surface 122. The stop 124 may function to limit the rotation of the cord lever 72 in relation to the cap 102. However, in accordance with a preferred operation, the relative travel of the cord lever 72 and the cap 102 is limited so that the stop 124 is not met.

In operation, an arrow is loaded with the right hand, the rest 38 that supports the arrow is rotated up (i.e., counterclockwise when viewing FIGS. 22-29) via the cord lever 72, for example, with the left thumb by actuating a thumb lever (not shown), which may be supported by the cord lever 72 or the cap 102. Actuating the thumb lever rotates the oscillator 50 (i.e., clockwise when viewing FIG. 7A), until the rest 38 comes to a stop at a vertical or capture position (shown in FIGS. 5A and 22-23) when the oscillator 50 hits the rubber bumpers on the stop pin 101. As the cord lever 72 is released, the dog 58, which is spring loaded via the torsion spring 59 to rotate up (i.e., clockwise when viewing FIG. 7B), catches on the locking pin 64 (shown in FIG. 7B). This stops the downward rotation of the rest 38 at approximately 15 degrees from the vertical or capture position (shown in FIGS. 5B and 24-25). This is the cocked or ready position, wherein the arrow is supported while waiting for the bow to be drawn. In this position, the laterally spaced arms 42 on the rest 38 and the containment bar 86 contain the arrow to keep the arrow from falling.

As the string 16 is drawn, the cord 78, which is attached to the cord lever 72 on one end and the bow string 16 on the other end, becomes taut. This rotates the rest 38 and all attached parts (i.e., in the counterclockwise direction when viewing FIGS. 22-23) back to the fully vertical or capture position (shown in FIGS. 5A and 22-23). As the string 16 is further drawn, the cord 78 rotates further the cord lever 72 (i.e., counterclockwise when viewing FIGS. 26-27), which twists or loads the torsion spring 104 with torque.

Figure 7B:
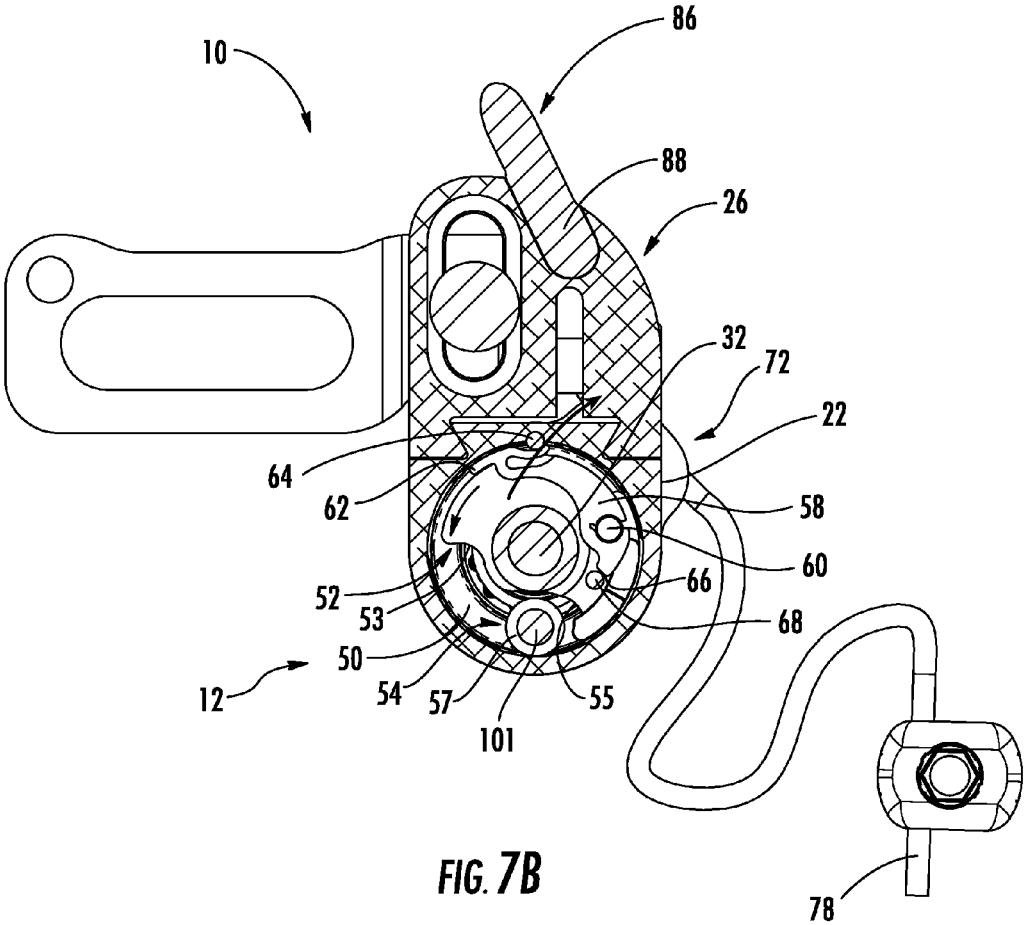
FIG. 7B is a cross-sectional view of the system and the mechanism shown in FIG. 7A but in the cocked position.
Figure 7C:
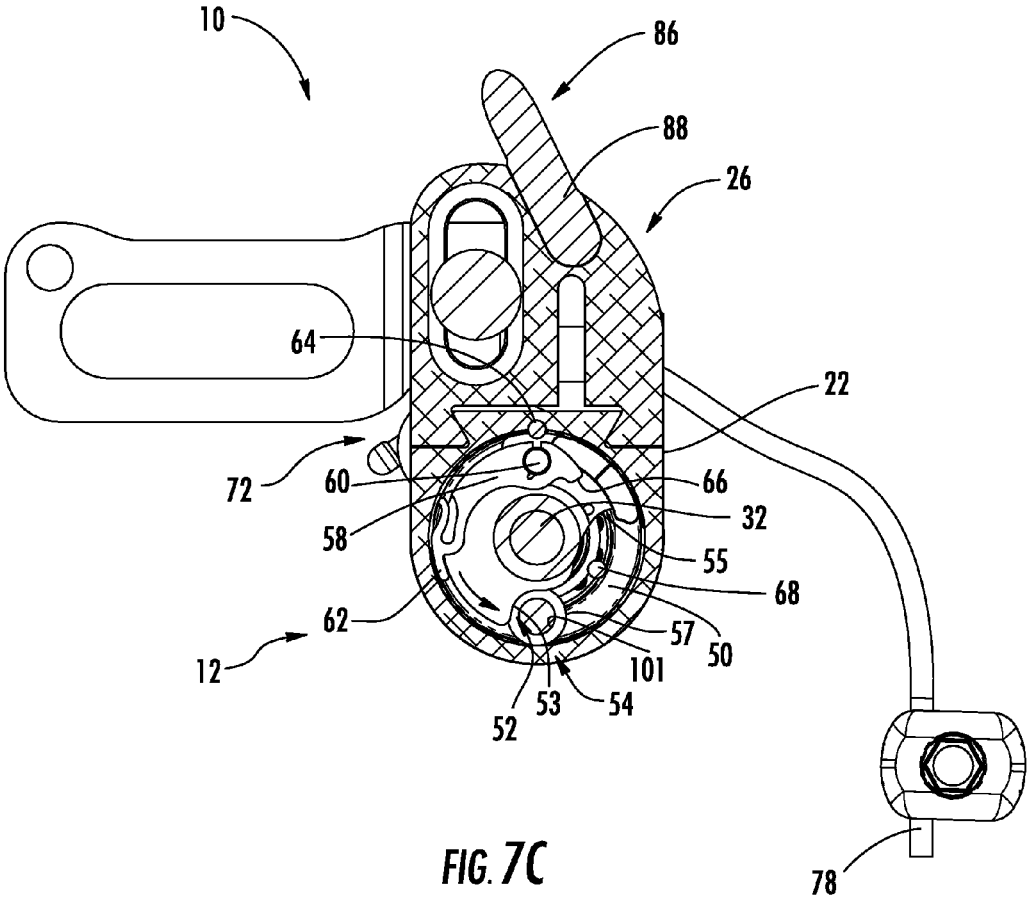
FIG. 7C is a cross-sectional view of the system and the mechanism shown in FIG. 7A but in a fired position.

If the bow is let down slowly, the cord lever 72 rotates to release the load or torque on the torsion spring 104, and then the cord 78 loosens. The main coil spring 56 forces the rest 38 down (i.e., counterclockwise when viewing FIG. 7B). The dog 58 is allowed to raise (i.e., clockwise when viewing FIG. 7B) and the slower velocity of the rotation of the rest 38 allows the dog 58 to catch on the locking pin 64, as shown in FIG. 7B. The rest 38 stops approximately at about 15 degrees from vertical back at the cocked or ready position shown in FIGS. 5B and 24-25.

If the bow is fired, the cord 78 becomes loose. The torque in the torsion spring 104 is released, rotating the cord lever 72 up (i.e., in a clockwise direction when viewing FIGS. 28-29). The main coil spring 56 then forces the rest 38 down (i.e., clockwise when viewing FIGS. 28-29). The dog 58 is allowed to raise but the velocity of the rotation of the rest 38 causes the dog 58 to pass the locking pin 64, allowing the rest 38 to completely drop away to the down or drop away position (shown in FIGS. 5C and 28-29) so that the arrow passes unobstructed.

The containment bar 86 and the laterally spaced arms 42 of the rest 38 totally capture the arrow. With an arrow loaded, the bow can be rotated upside down, even at full draw, without the arrow falling off the rest.

At full draw, the rest 38 is fully vertical. This offers higher repeatability as the arrow contact point is directly vertical of its pivot point, the axial center of the shaft 30. Therefore, any fluctuations of the rest stopping point, results in less vertical arrow position change.

It should be clearly understood that the torque applied to the torsion spring 104 will first be released when the bow is fired. This will cause the cord lever 72 to first rotate before triggering the release of the rest 38 to the drop away position. This will allow additional time (e.g., several milliseconds) for the arrow to travel supported by the rest 38. In other words, rotation of the cord lever 72 prior to triggering the release of the rest 38 to the drop away position results in a time delay. The time delay delays the release of the rest 38 to a drop away position for a period of time after the arrow is shot, thus providing support for the arrow after the arrow is shot. This increases the accuracy of the shot.

Figure 34:
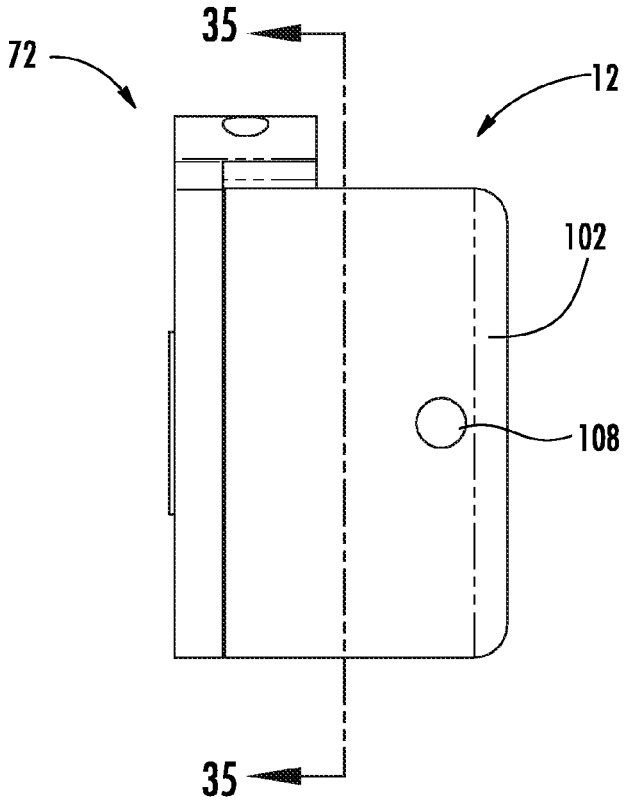
FIG. 34 is an enlarged front elevational view of the mechanism shown in FIG. 26.
Figure 35:
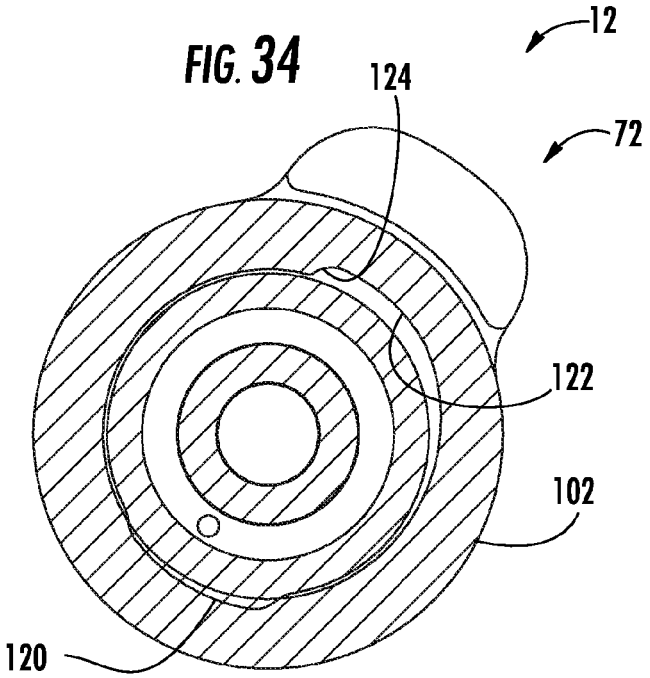
FIG. 35 is a cross-sectional view of the mechanism taken along line 35-35 in FIG. 34.

The dampening effect of the mechanism 12 is best understood with reference to FIGS. 30-35. The cord lever 72 and cap 102 are in the position shown in FIGS. 30-31 when the rest 38 is in the vertical or capture position (e.g., when actuated by a thumb lever or by drawing the string 16). Upon releasing the thumb lever or slowly releasing the string 16 (i.e., a slow let down), the cord lever 72 and cap 102 move counterclockwise to the position shown in FIGS. 32-33. In this position, the cord lever 72 is essentially unencumbered by the cap 102. When the string 16 is released to shoot an arrow, the cord lever 72 and cap 102 move clockwise to the position shown in FIGS. 32-33. During this movement, the radially extending projection 120 engages the cam surface 122, as shown in FIGS. 34-35. The interference between the radially extending projection 120 and the cam surface 122 increases. This interference dampens the release of the rest 38 to the drop away position, which reduces the risk that the rest 38 will bounce back.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A drop away arrow rest system with delayed release mechanism comprising:

a drop away arrow rest system comprising:

a rest, and a cord lever operatively connected to the rest for moving the rest to a cocked position for supporting an arrow in relation to a bow upon drawing a bow string and upon releasing the bow string, triggering the release of the rest to a drop away position; and a delayed release mechanism comprising:

a cap, and a torsion spring connecting the cap to the cord lever, the cord lever being configured to load the torsion spring upon drawing the bow string and upon releasing the bow string, first release the load on the torsion spring without triggering the release of the rest to a drop away position, and then trigger the release of the rest to a drop away position.

2. The drop away arrow rest system of claim 1, wherein the torsion spring is adjustable to trigger the rest to rotate to the drop away position out of the way of the arrow and clear fletching of the arrow.

3. The drop away arrow rest system of claim 1, wherein the torsion spring comprises a helical spring having a first portion that cooperates with the cord lever and a second portion that cooperates with the cap, wherein the torsion spring is pre-loaded by twisting the torsion spring to increase torque applied by the torsion spring.

4. The drop away arrow rest system of claim 3, wherein the first portion comprises a first finger at one end of the torsion spring and the second portion comprises a second finger at a second end of the torsion spring opposite the first end, the first finger cooperating with a hole in the cord lever and the second finger cooperating with a hole in the cap.

5. The drop away arrow rest system of claim 4, wherein the hole in the cap is one of a plurality of holes within the cap, and the torsion spring is configured to be pre-loaded with torque by inserting the second finger in any one of the plurality of holes.

6. The drop away arrow rest system of claim 5, wherein the plurality of holes is arranged in a circular pattern at the end of the cap and coaxially about the axis of the cap.

7. The drop away arrow rest system of claim 1, wherein the cord lever has a reduced dimension portion that is dimensioned to fit within the cap and a radially extending projection that extends from the reduced dimension portion and is defined by an outer wall of the reduced dimension portion, the radially extending projection cooperating with a cam surface within the cap to function to dampen the relative movement of the cord lever and the cap.

8. The drop away arrow rest system of claim 7, wherein the cam surface is defined by an inner wall of the cap.

9. The drop away arrow rest system of claim 7, wherein the cap has a stop at one end of the cam surface that functions to limit the rotation of the cord lever in relation to the cap.

10. The drop away arrow rest system of claim 9, wherein the relative travel of the cord lever and the cap is limited by the cooperation of the radially extending projection with a cam surface so that the stop is not met.

11. A drop away rest system for providing a rest for supporting an arrow in relation to a bow upon drawing a bow string and upon releasing the bow string, triggering the release of the rest to a drop away position clear of the arrow, the drop away rest system comprising:

a housing having a hollow interior, a shaft having an interior segment that is rotatably supported within the housing and an exterior segment that extends beyond the housing, a rest upon which the arrow may be positioned, the rest being supported in relation to the exterior segment of the shaft, a cord lever operatively connected to the rest for moving the rest to a cocked position for supporting an arrow in relation to a bow upon drawing a bow string and upon releasing the bow string, triggering the release of the rest to a drop away position; and a cord having a first end secured to the cord lever and a second end with a coupling configured to couple the cord to the bow string so that pulling the bow string will pull the cord and rotate the cord lever and the shaft and the rest from the cocked position to a capture position, and release of the bow string will trigger rotation of the shaft and the rest from the capture position to a drop away position, a delayed release mechanism comprising:

a cap, and a torsion spring connecting the cap to the cord lever, the cord lever being configured to load the torsion spring upon drawing the bow string and upon releasing the bow string, first release the load on the torsion spring without triggering the release of the rest to a drop away position, and then trigger the release of the rest to a drop away position.

12. The drop away arrow rest system of claim 11, wherein the torsion spring is adjustable to trigger the rest to rotate to the drop away position out of the way of the arrow and clear fletching of the arrow.

13. The drop away arrow rest system of claim 11, wherein the torsion spring comprises a helical spring having a first portion that cooperates with the cord lever and a second portion that cooperates with the cap, wherein the torsion spring is pre-loaded by twisting the torsion spring to increase torque applied by the torsion spring.

14. The drop away arrow rest system of claim 13, wherein the first portion comprises a first finger at one end of the torsion spring and the second portion comprises a second finger at a second end of the torsion spring opposite the first end, the first finger cooperating with a hole in the cord lever and the second finger cooperating with a hole in the cap.

15. The drop away arrow rest system of claim 14, wherein the hole in the cap is one of a plurality of holes within the cap, and the torsion spring is configured to be pre-loaded with torque by inserting the second finger in any one of the plurality of holes.

16. The drop away arrow rest system of claim 15, wherein the plurality of holes is arranged in a circular pattern at the end of the cap and coaxially about the axis of the cap.

17. The drop away arrow rest system of claim 11, wherein the cord lever has a reduced dimension portion that is dimensioned to fit within the cap and a radially extending projection that extends from the reduced dimension portion and is defined by an outer wall of the reduced dimension portion, the radially extending projection cooperating with a cam surface within the cap to function to dampen the relative movement of the cord lever and the cap.

18. The drop away arrow rest system of claim 17, wherein the cam surface is defined by an inner wall of the cap.

19. The drop away arrow rest system of claim 17, wherein the cap has a stop at one end of the cam surface that functions to limit the rotation of the cord lever in relation to the cap.

20. The drop away arrow rest system of claim 19, wherein the relative travel of the cord lever and the cap is limited by the cooperation of the radially extending projection with a cam surface so that the stop is not met.

21. The drop away arrow rest system of claim 11, wherein the cord lever has a radially extending thumb lever for rotation by a user to rotate the shaft and the rest to the cocked position.

22. The drop away arrow rest system of claim 11, further comprising one or more coupling components for coupling the housing to the bow.

23. The drop away arrow rest system of claim 11, further comprising a containment bar having a fixed end that is secured to the housing, the fixed end having an intermediate region, which is positioned over and in proximity to the rest so that the arrow on the rest is prevented from falling away and remains contained when hunting, drawing or during slow let down.

* * * * *